US008074591B2

(12) United States Patent
Butcher et al.

(10) Patent No.: US 8,074,591 B2
(45) Date of Patent: Dec. 13, 2011

(54) EMBROIDERY USING SOLUBLE THREAD

(75) Inventors: Peter Butcher, Nottingham (GB); Christopher Reah, Taunton (GB)

(73) Assignee: NuVasive, Inc., San Diego, CA (US)

( * ) Notice: Subject to any disclaimer, the term of this patent is extended or adjusted under 35 U.S.C. 154(b) by 373 days.

(21) Appl. No.: 12/442,944

(22) PCT Filed: Sep. 25, 2007

(86) PCT No.: PCT/US2007/020782

§ 371 (c)(1), (2), (4) Date: Mar. 25, 2009

(87) PCT Pub. No.: WO2008/039497

PCT Pub. Date: Apr. 3, 2008

(65) Prior Publication Data

US 2010/0089297 A1 Apr. 15, 2010

Related U.S. Application Data

(60) Provisional application No. 60/847,022, filed on Sep. 25, 2006.

(51) Int. Cl.
*D05B 93/00* (2006.01)

(52) U.S. Cl. ..... 112/475.18

(58) Field of Classification Search ..... 112/78, 112/236, 475.18, 439, 475.21, 475.22, 475.23; 606/73; 623/901

See application file for complete search history.

(56) References Cited

U.S. PATENT DOCUMENTS

| | | | | |
|---|---|---|---|---|
| 0,889,614 | A | | 6/1908 | Johnsen |
| 0,924,795 | A | | 6/1909 | Klemm et al. |
| 2,687,703 | A | | 8/1954 | Shotsky |
| 3,183,868 | A | | 5/1965 | Shotsky |
| 3,270,696 | A | | 9/1966 | Lowenstein |
| 3,859,941 | A | * | 1/1975 | Krieger ..... 112/475.22 |
| 4,517,910 | A | | 5/1985 | Jalowsky |
| 4,776,851 | A | | 10/1988 | Bruchman et al. |
| 4,790,850 | A | | 12/1988 | Dunn et al. |
| 4,904,260 | A | | 2/1990 | Ray et al. |
| 4,946,377 | A | | 8/1990 | Kovach |
| 5,004,474 | A | | 4/1991 | Fronk et al. |
| 5,108,397 | A | | 4/1992 | White |
| 5,192,322 | A | | 3/1993 | Koch et al. |
| 5,540,703 | A | | 7/1996 | Barker, Jr. et al. |
| 5,571,189 | A | | 11/1996 | Kuslich |
| 5,794,555 | A | | 8/1998 | Kwang |
| 5,800,543 | A | | 9/1998 | McLeod et al. |
| 5,990,378 | A | | 11/1999 | Ellis |
| 6,033,429 | A | | 3/2000 | Magovern |
| 6,093,205 | A | | 7/2000 | McLeod et al. |
| 6,248,106 | B1 | | 6/2001 | Ferree |
| 6,263,817 | B1 | | 7/2001 | Tajima et al. |

(Continued)

FOREIGN PATENT DOCUMENTS

EP 0192949 A1 9/1986

(Continued)

*Primary Examiner* — Larry Worrell, Jr.

(74) *Attorney, Agent, or Firm* — NuVasive, Inc.; Jonathan Spangler; Marjorie Jarvis

(57) ABSTRACT

A manufacturing process and resultant medical devices and components thereof wherein one or more individual laces (12) is placed within an embroidered structure (10) using an automated process allowing for the manufacture of embroidered surgical implants containing laces to be mass produced repeatably and cost effectively.

22 Claims, 16 Drawing Sheets

U.S. PATENT DOCUMENTS

| | | | | |
|---|---|---|---|---|
| 6,283,998 | B1 | 9/2001 | Eaton | |
| 6,368,326 | B1 | 4/2002 | Dakin et al. | |
| 6,416,776 | B1 | 7/2002 | Shamie | |
| 6,419,704 | B1 | 7/2002 | Ferree | |
| 6,428,544 | B1 | 8/2002 | Ralph et al. | |
| 6,592,625 | B2 | 7/2003 | Cauthen | |
| 6,620,196 | B1 | 9/2003 | Trieu | |
| 6,712,853 | B2 | 3/2004 | Kuslich | |
| 6,746,485 | B1 | 6/2004 | Zucherman et al. | |
| 6,893,466 | B2 | 5/2005 | Trieu | |
| 7,156,848 | B2 | 1/2007 | Ferree | |
| 7,214,225 | B2 | 5/2007 | Ellis et al. | |
| 7,229,441 | B2 | 6/2007 | Trieu et al. | |
| 7,338,531 | B2 | 3/2008 | Ellis et al. | |
| 7,601,166 | B2 | 10/2009 | Biedermann et al. | |
| 7,655,044 | B2 | 2/2010 | Kwak | |
| 7,713,463 | B1 | 5/2010 | Reah et al. | |
| 7,828,855 | B2 | 11/2010 | Ellis et al. | |
| 7,942,104 | B2 | 5/2011 | Butcher et al. | |
| 7,946,236 | B2 | 5/2011 | Butcher | |
| 2001/0027319 | A1 | 10/2001 | Ferree | |
| 2003/0074075 | A1 | 4/2003 | Thomas, Jr. et al. | |
| 2003/0078579 | A1 | 4/2003 | Ferree | |
| 2004/0015166 | A1 | 1/2004 | Gorek | |
| 2004/0078089 | A1 * | 4/2004 | Ellis et al. | 623/23.74 |
| 2004/0113801 | A1 | 6/2004 | Gustafson et al. | |
| 2004/0186573 | A1 | 9/2004 | Ferree | |
| 2006/0179652 | A1 | 8/2006 | Petersen et al. | |
| 2007/0005062 | A1 | 1/2007 | Lange et al. | |
| 2007/0073293 | A1 | 3/2007 | Martz et al. | |
| 2007/0204783 | A1 | 9/2007 | Chong | |
| 2007/0239158 | A1 | 10/2007 | Trieu et al. | |
| 2007/0276490 | A1 | 11/2007 | Mateyka | |
| 2007/0276494 | A1 | 11/2007 | Ferree | |
| 2008/0015697 | A1 | 1/2008 | McLeod et al. | |
| 2008/0173223 | A1 | 7/2008 | Butcher et al. | |
| 2008/0178786 | A1 | 7/2008 | Butcher | |
| 2008/0234753 | A1 | 9/2008 | Trieu | |
| 2009/0131984 | A1 | 5/2009 | Linares | |
| 2009/0138082 | A1 | 5/2009 | Reah et al. | |

FOREIGN PATENT DOCUMENTS

| | | | | |
|---|---|---|---|---|
| EP | 0260970 | A2 | | 3/1988 |
| EP | 0314412 | A1 | | 5/1989 |
| EP | 0599419 | A2 | | 6/1994 |
| EP | 0744165 | B1 | | 2/2003 |
| EP | 0744162 | A1 | * | 5/2003 |
| EP | 2189123 | A1 | | 5/2005 |
| FR | 269338 | A1 | | 4/1994 |
| FR | 2710520 | A1 | | 4/1995 |
| FR | 2929101 | A1 | | 10/2009 |
| GB | 2276823 | A | | 10/1992 |
| WO | WO 90/11735 | A1 | | 10/1990 |
| WO | WO 92/03988 | A1 | | 3/1992 |
| WO | WO 92/10982 | A1 | | 7/1992 |
| WO | WO 99/37242 | A1 | | 7/1999 |
| WO | WO 01/21246 | A1 | | 3/2001 |
| WO | WO 0130269 | A1 | * | 5/2001 |
| WO | WO 02/30306 | A1 | | 4/2002 |
| WO | WO 02/30324 | A1 | | 4/2002 |
| WO | WO 2004/002374 | A1 | | 1/2004 |
| WO | WO 2005/092211 | A1 | | 10/2005 |
| WO | WO 2005/092247 | A1 | | 10/2005 |
| WO | WO 2005/092248 | A1 | | 10/2005 |
| WO | WO 2006/133130 | A2 | | 12/2006 |
| WO | WO 2007/012070 | A2 | | 1/2007 |

* cited by examiner

EMBROIDERY USING SOLUBLE THREAD

CROSS-REFERENCES TO RELATED APPLICATIONS

The present international patent application claims the benefit of priority from commonly owned and co-pending U.S. Provisional Patent Application Ser. No. 60/847,022, entitled "Embroidery Using Soluble Thread," filed on Sep. 25, 2006, the entire contents of which are hereby expressly incorporated by reference into this disclosure as if set forth fully herein.

BACKGROUND OF THE INVENTION

I. Field of the Invention

The present invention relates to medical devices and methods generally aimed at surgical implants. In particular, the disclosed system and associated methods are related to a manner of creating surgical implants via embroidery.

II. Discussion of the Prior Art

Embroidered structures are created on substrates. Some substrates are designed to stay in place with the embroidered structure while other substrates are removed at the end of the embroidery process. If the substrate is designed to be removed, the preferred method of removal is dissolution. The dissolution processes discussed, however, are not intended to preclude the use of other means of substrate removal which those skilled in the art would employ in the manufacture of an embroidered structure, or the omission of substrate removal.

As an initial step in the creation of embroidered structures, a plurality of parallel, stationary backing threads are placed and secured on one surface of a substrate, called the "backing surface." On the opposing surface of the substrate, called the "stitching surface," is a plurality of stitching threads with one-to-one correspondence to the backing threads. Stitching may be done between one pair of threads at a time or in simultaneous multiplicity, as is described below.

The plurality of stitching threads from the stitching surface are passed to the backing surface through openings created in the substrate by the passing of each individual thread. Each stitching thread is then looped over its corresponding backing thread, in essence picking up the backing thread, which creates a lock stitch. Once each stitching thread has picked up its corresponding backing thread, the plurality of stitching threads are returned to the stitching surface by passing through the openings in the substrate created by initially passing the stitching threads to the backing surface. The lock stitches prevent the stitching threads from completely pulling back out of the openings created in the substrate. The plurality of stitching threads are then moved to a new stitching site and the process repeats until all the backing threads are joined by lock stitches to the corresponding stitching threads, creating a plurality of thread pairs of some length.

A plurality of thread pairs may be enclosed by one or more pluralities of enclosing thread pairs. To enclose a plurality of thread pairs, a subsequent plurality of backing threads are placed and secured on the backing surface of a substrate already holding at least one plurality of thread pairs, such that the subsequent plurality of backing threads covers the previously stitched plurality of backing threads. A subsequent plurality of backing threads is usually not parallel with the previous plurality of backing and stitching threads. A subsequent plurality of stitching threads, with one-to-one correspondence to the subsequent plurality of backing threads, is then stitched to the subsequent plurality of backing threads by the stitching process described above.

When the subsequent plurality of backing threads are all joined to the subsequent plurality of stitching threads by lock stitches over a desired distance, a plurality of enclosing thread pairs has been formed, enclosing all previously stitched pairs. This process may be repeated by stitching even further subsequent pluralities of enclosing thread pairs over the previously stitched thread pairs and enclosing thread pairs, such that, for example, the first plurality is enclosed by a second plurality, which is enclosed by a third plurality, which is enclosed by a fourth plurality, and so forth. This process produces stable embroidered structures which do not unravel into a pile of threads if the substrate is removed.

If the substrate is intended to be removed, the removal process is dependent upon the material from which the substrate is composed. If dissolution is the removal method chosen, the substrate materials are chosen such that the process which dissolves the substrate will minimally affect the physical properties of the stitching or backing threads used in the embroidered structure. When the substrate is removed, only the stitching and backing threads remain, in whatever combination of thread pairs and enclosing thread pairs that were utilized. The embroidered structure remains intact despite the removal of the substrate because each stitching thread is stitched to its corresponding backing thread, and vice versa, which is enclosed in one or more pluralities of enclosing thread pairs, all of which provides structural support.

In some applications, it may be advantageous to have an independent, unpaired thread, referred to as a "lace," existing within an embroidered structure. Based upon the methodology of embroidered structure creation above, however, any lace within an embroidered structure would have to be placed after completion of the embroidery process because all threads are stitched, and thus paired, during the embroidery process. On a basic level, one or more laces may be added to an embroidered structure by hand, but this is possible only with the simplest of embroidered structures. The manual placement of laces is also expensive, not easily repeatable, and not conducive to mass production.

Repeatability is paramount in medical applications because devices may work reliably in one configuration, but variations of such a configuration may cause the device to perform unreliably, inadequately, or even fail to perform altogether. Repeatable placement of a lace within an embroidered structure used for surgical implantation requires a level of reproducibility exceeding that which may be achieved manually. Repeatability notwithstanding, the expense required to manually add one or more laces to embroidered structures further limits the use of manual insertion techniques, as does the bottleneck such manual insertions would cause in a manufacturing environment.

The present invention overcomes, or at least minimizes, the limitations associated with placing one or more laces within an embroidered structure.

SUMMARY OF THE INVENTION

According to the present invention, there is provided a manufacturing process by which an embroidered structure may be created containing within the structure one or more independent, unpaired threads laces, in a manner which is repeatable, inexpensive, and conducive to mass production.

The advantages to placing laces using the process of the present invention are: (1) ease of manufacture of complex devices; (2) the ability to make more complex devices; (3) the ability to improve the repeatability of strength critical items; (4) the ability to pre-load seams; and (5) the ability to create three-dimensional shapes.

The process of the present invention may use any of a variety of commercially available, automated embroidery machines and/or any other non-manual technique used to manufacture embroidered structures. A soluble thread composed of acetate (for example) or other soluble material is used as the corresponding partner thread for the lace thread during the embroidery process. The lace thread is stitched with the soluble thread, forming in the embroidered structure a temporary thread pair in the same creation process in which all the other threads in the embroidered structure are stitched. The soluble thread may be either the stitching thread or backing thread, and thus the lace may be placed into the embroidered structure as either the stitching or backing thread.

After the stitching of the embroidered structure is complete, the soluble thread is dissolved. The dissolution process used must be suitable for dissolving the material of the soluble thread and should preferably not negatively alter the physical properties of the lace and other threads in the embroidered structure. Once the soluble thread is removed, the temporary thread pair formed by the soluble thread being stitched with the lace ceases to exist, and the lace is no longer a part of the support system of the embroidered structure. This leaves the lace as a single, unpaired thread within the embroidered structure of paired threads.

Removal of the substrate may be done before, during and/or after the dissolution of the soluble thread, depending upon the properties of the materials used for the substrate and soluble thread and any specific manufacturing concerns compelling the sequence of removal. If dissolution is the method of removal selected, the dissolution processes for the substrate will not only depend upon the substrate material, but also the material of the soluble threads, laces and other threads in the embroidered structure to ensure that the process only affects the materials targeted by the process.

Since the lace was a part of the embroidered structure as it was being created and not placed from outside the otherwise finished embroidered structure, and because the creation was performed non-manually, the positional repeatability of the lace within the embroidered structure is high. The replacement of standard threads with soluble threads and the addition of a process to remove the soluble thread, if not removed during a substrate dissolution process, only nominally increases the cost of manufacturing with laces as opposed to without, and the cost increase is significantly less that of the cost of placing laces by hand. Finally, since the method of creation may be automated using commercially available embroidery machines, the embroidered structures containing laces may be mass produced. Thus, the present invention overcomes, or at a minimum improves upon, the limitations associated with repeatability, expense, and mass producibility inherent to the prior art.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The process of embroidery with soluble thread disclosed herein boasts a variety of inventive features and components that warrant patent protection, both individually and in combination.

Figure 1:
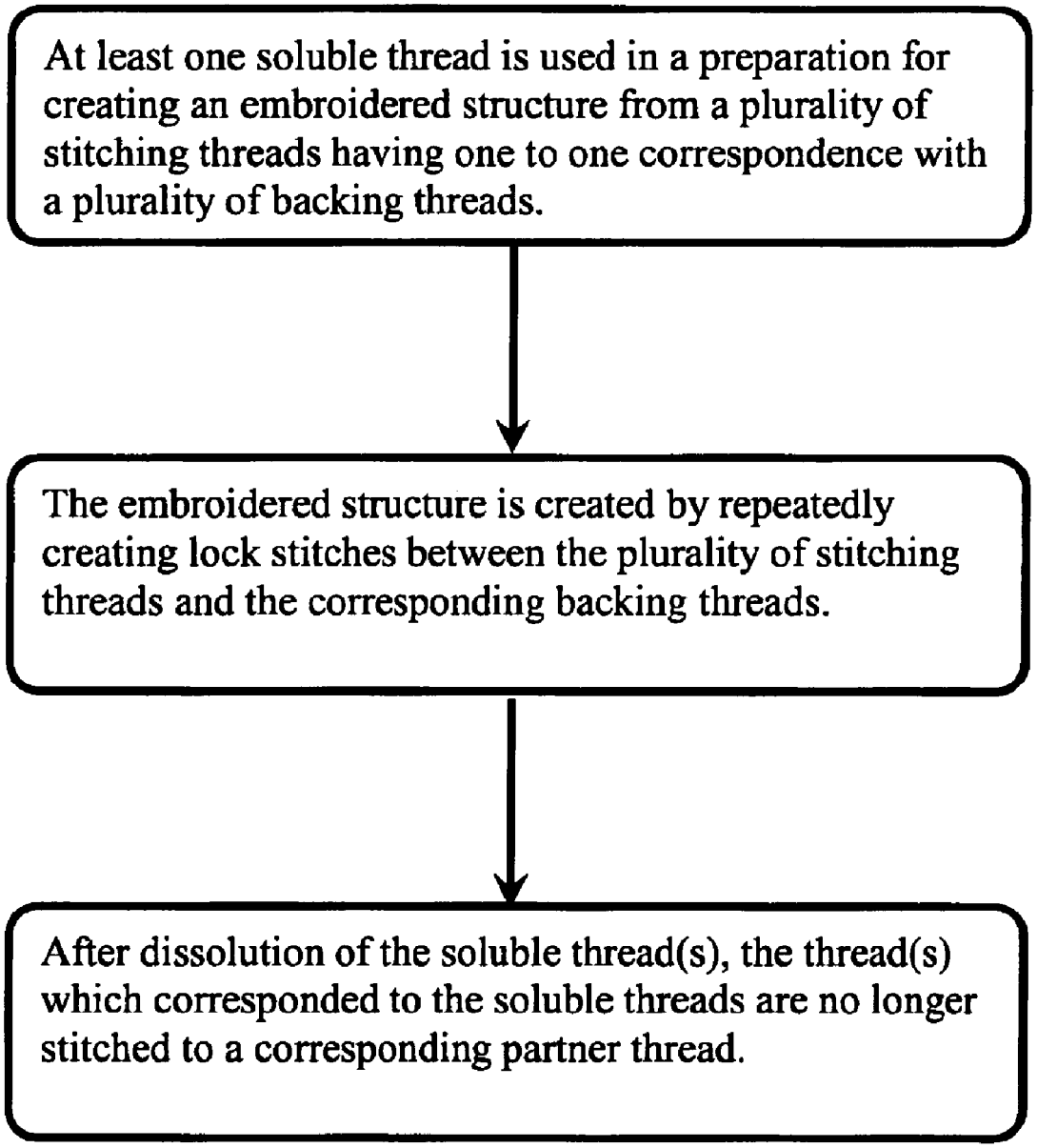
FIG. 1 is a flow chart depicting one example of a general process of placing laces in embroidered structures using one or more soluble threads, according to one embodiment of the present invention.

FIG. 1 outlines the one example of the process of manufacturing an embroidered structure using soluble thread according to one embodiment of the present invention. The process begins with a substrate, upon which a plurality of backing threads are placed and secured on one side, called the backing surface. A soluble thread may be substituted for any backing thread within the plurality of backing threads. For each backing thread on the backing surface of the substrate, there is a corresponding stitching thread on the opposing side of the substrate, called the stitching surface. A soluble thread may be substituted for any stitching thread within the plurality of stitching threads. Any soluble thread, used on either the backing surface or the stitching surface, will correspond to a lace on the opposing surface. Laces may be physically identical to the stitching threads or backing threads or may be composed of different materials or possess different physical properties than the stitching threads or backing threads.

Stitching may be done between one pair of threads at a time or in simultaneous multiplicity, as is described below. The plurality of stitching threads, lace threads, and/or soluble threads on the stitching surface are passed from the stitching surface to the backing surface, making openings in the substrate for each individual thread, to meet with corresponding backing threads, soluble threads, and/or laces on the backing surface. Each stitching thread, lace, and/or soluble thread from the stitching surface is then looped over its corresponding backing thread, soluble thread, and/or laces on the backing surface. In essence, this looping over engages or "picks up" each thread from the backing surface, creating a "lock stitch." Once each thread from the stitching surface has picked up its corresponding thread from the backing surface, the plurality of threads originating from the stitching surface are returned from the backing surface to the stitching surface through the same openings made upon initial passage through the substrate from the stitching surface. The lock stitch prevents the threads from completely pulling out of the openings made when returning to the stitching surface through the substrate.

The process then repeats at a distance from the last stitch site, and continues to repeat until each thread from the stitching surface and its corresponding thread from the backing surface are joined by lock stitches over a desired length. The end result is a plurality of stitching threads stitched to backing threads in thread pairs held together by lock stitches. Each thread pair is parallel to the rest of the thread pairs on the substrate. Also parallel to the thread pairs are the one or more temporary thread pairs formed by stitching laces to corresponding soluble threads.

A plurality of parallel stitched thread pairs and temporary thread pairs may be enclosed by enclosing thread pairs. To enclose a previously stitched plurality of thread pairs and temporary thread pairs, the embroidery process above is repeated over the previous embroidery already on the substrate. This process may be repeated further by embroidering subsequent pluralities of enclosing thread pairs over each other in a manner such that the first plurality of enclosing thread pairs is enclosed by the second plurality of enclosing thread pairs, which is enclosed by a third plurality, which is enclosed by a fourth plurality, and so forth. This process of producing embroidered structures containing multiple pluralities of enclosing thread pairs results in stable embroidered structures which do not unravel into a pile of threads upon removal of the substrate.

The process of substrate removal, if not omitted, is dependent upon the material from which the substrate is composed. Removal of the substrate may be done before, after or simultaneously with the dissolution of the soluble thread(s). If dissolution is the chosen method or removal, the selection of materials used to form the substrate and soluble thread will be in part compelled by any manufacturing concerns regarding the sequence of dissolution. Substrate and soluble thread materials are chosen such that the process or processes which dissolve the substrate and soluble thread will not negatively alter the physical properties of the stitching threads, backing threads, and/or laces.

If the substrate is removed and the soluble threads are dissolved, only the stitching threads, backing threads, and/or laces will remain. The embroidered structure remains intact despite the removal of the substrate because each stitching thread is stitched to its corresponding backing thread, and vice versa, which is enclosed in one or more pluralities of enclosing thread pairs, all of which provides structural support. Once both the soluble threads and substrate are removed, the laces are no longer a part of the support system of the embroidered structure because the temporary thread pairs cease to exist when the soluble threads are dissolved, leaving the laces as single, unpaired threads within the embroidered structure.

Figure 2:
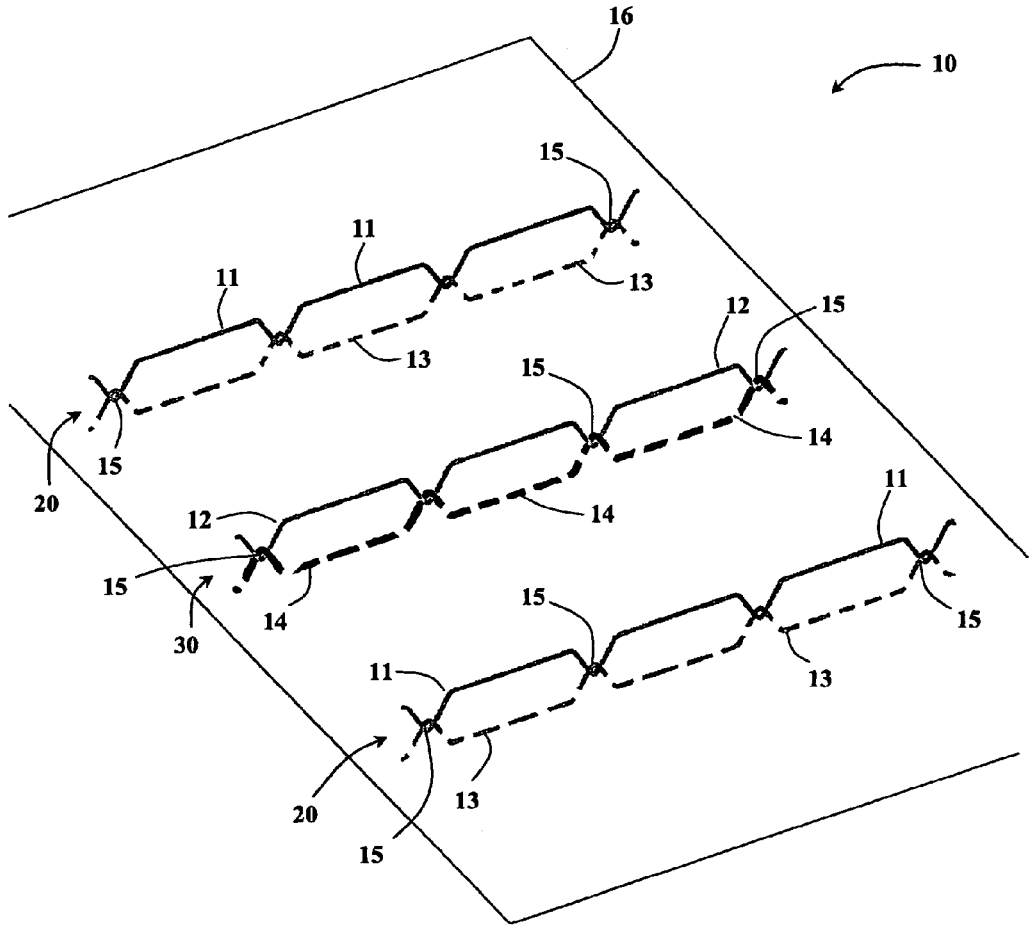
FIG. 2 is a perspective view one example of an embroidered structure having a plurality of thread pairs, including a temporary thread pair, formed according to the process of FIG. 1.

FIG. 2 is an example of an embroidered structure 10 during creation by the process of manufacture according to one embodiment of the present invention. Each thread pair 20 is created by stitching together a stitching thread 11 and a backing thread 13 to form lock stitches 15 on a substrate 16. The temporary thread pair 30 is created by stitching together a lace 12 and a soluble thread 14 to form lock stitches 15.

Figure 3:
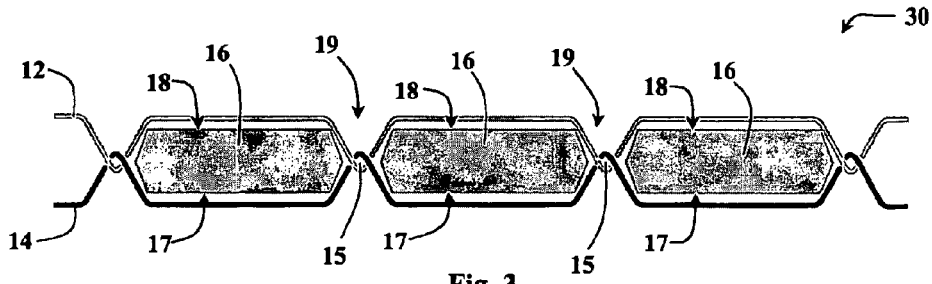
FIG. 3 is a plan view of a soluble thread stitched to a lace thread to form the temporary thread pair of FIG. 2.

FIG. 3 is a closer view of the temporary thread pair 30 from the embroidered structure 10 in FIG. 2. The lace 12 is substituted for a stitching thread and has passed from the stitching surface 18, creating an opening 19 through the substrate 16, to the backing surface 17. There it engaged the soluble thread 14 forming a lock stitch 15 and returned to the stitching surface 18 through the same opening 19. This process is repeated at intervals along the path of the soluble thread 14 until the desired length of stitching has been achieved. Although the lace 12 has been substituted for a stitching thread in this embodiment, the inverse is equally applicable, where a soluble thread 14 could be substituted for a stitching thread to form a temporary thread pair 30 with a lace 12 having been substituted for a backing thread.

Figure 4:
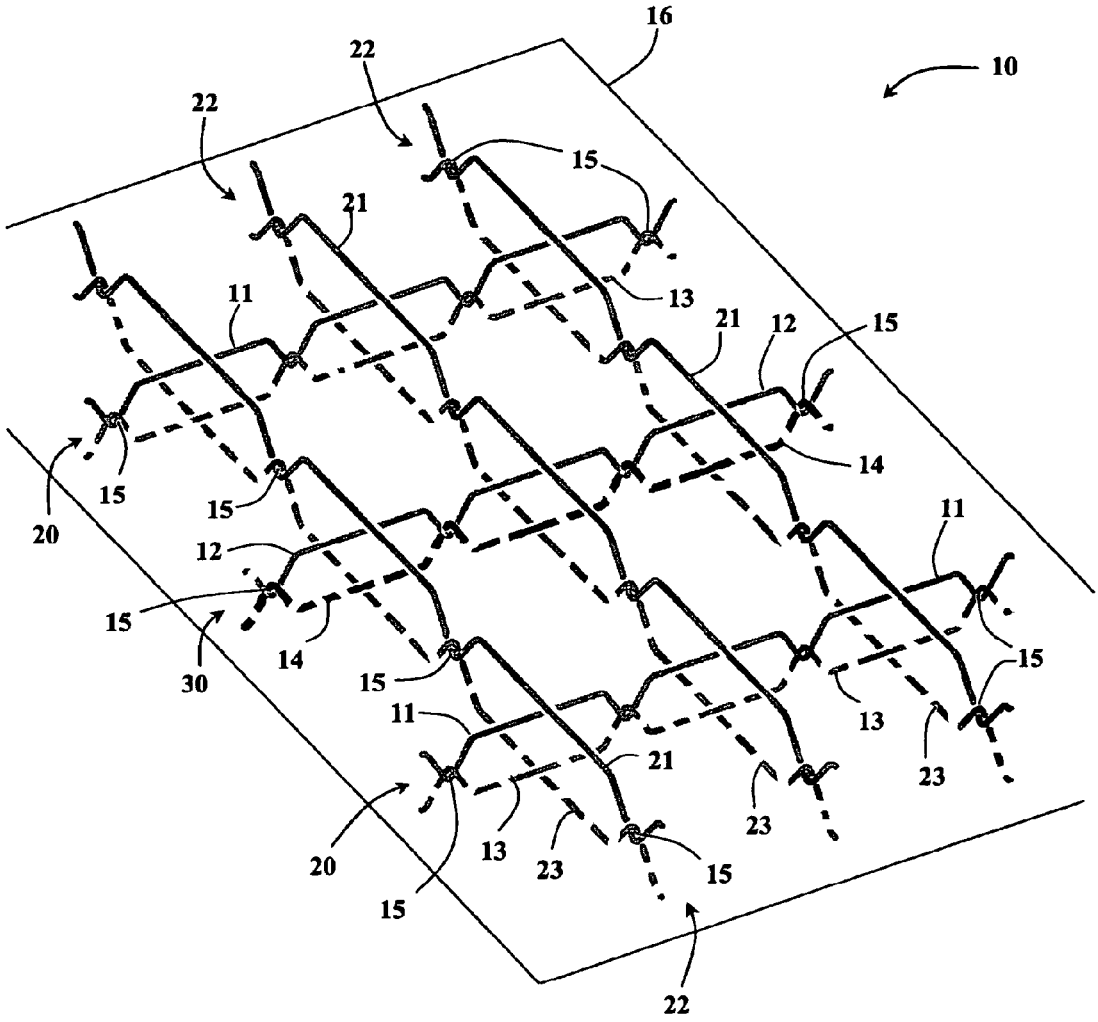
FIG. 4 is a perspective view of the embroidered structure of FIG. 2 after enclosing thread pairs are used to enclose the initial thread pairs and temporary thread pair.

FIG. 4 depicts the embroidered structure 10 created by enclosing the thread pairs 20 and temporary thread pair 30 from FIG. 2 with enclosing thread pairs 22. The enclosing thread pairs 22 contain enclosing backing threads 23 and enclosing stitching threads 21. The enclosing backing threads 23 are placed and secured on the backing surface of the substrate 16 over the thread pairs 20 and temporary thread pair 30. The enclosing stitching threads 21 are stitched from over the thread pairs 20 and temporary thread pair 30 on the stitching surface 18 of the substrate 16 by the process discussed above. The result is an embroidered structure 10 where thread pairs 20 and temporary thread pairs 30 are enclosed within the enclosing thread pairs 22.

The embroidered structure 10 is shown by way of example enclosed by a first plurality of enclosing thread pairs 22. The same stitching process or a different stitching process may be repeated or performed one or more times using the same or different thread materials to enclose thread pairs 20 and temporary thread pairs 30 by multiple pluralities of enclosing thread pairs 22 such that each subsequent plurality of enclosing thread pairs encloses all thread pairs 20, temporary thread pairs 30 and previous enclosing thread pairs 22 over which it is embroidered.

Figure 5:
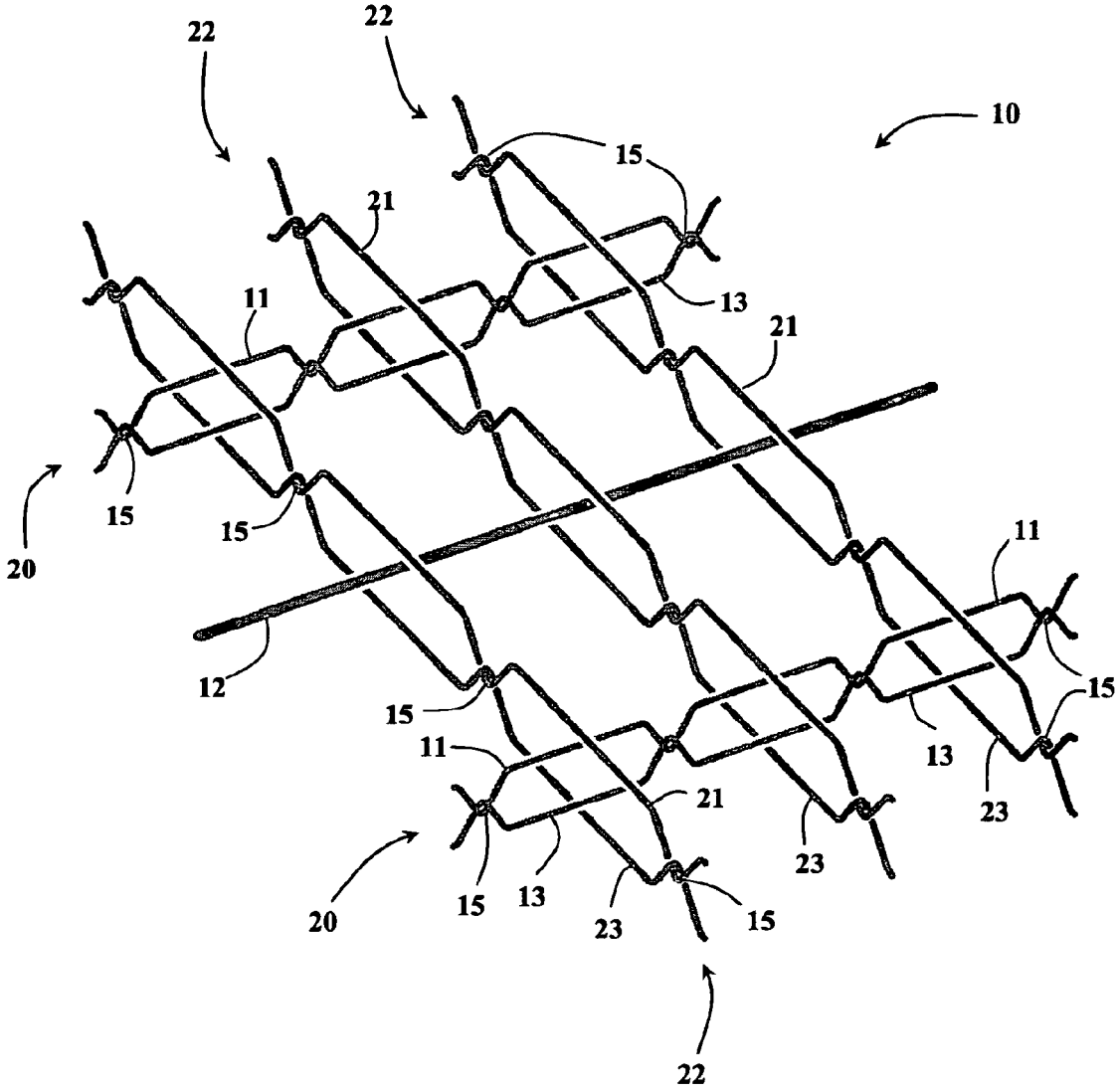
FIG. 5 is a perspective view of the embroidered structure of FIG. 4 after dissolution of the soluble thread and removal of the substrate.

FIG. 5 shows the embroidered structure 10 from FIG. 4 after dissolution of the soluble thread 14 and dissolvable substrate 16. Once the structure 10 from FIG. 4 is embroidered with the desired number of thread pairs 20 and temporary thread pairs 30, and enclosed by the desired number of enclosing thread pairs 22, the soluble thread 14 may be dissolved and the substrate 16 may be removed. The dissolution of the soluble thread 14 and removal of the substrate 16 may be done in the same or different processes, and in any order. If dissolution is the chosen method of substrate removal, the dissolution processes will depend upon the composition of the soluble threads 14 and the stitching threads 11, laces 12, backing threads 13, enclosing stitching threads 21, and enclosing backing threads 23 as well as the composition of the substrate 16 upon which the embroidered structure 10 was created. These compositions are application dependent and different materials may be used according to not only dissolution processes, but also the function of the completed embroidered structure 10. After dissolution of the soluble thread 14 and substrate 16 is completed, the lace 12 is no longer a part of a temporary thread pair, and thus is unpaired within the embroidered structure 10.

FIGS. 6-25 illustrate multiple embodiments of embroidered structures created using the manufacturing process described above. For the purposes of simplicity and consistency, features common to those shown and described in relation to embroidered structure 10 of FIGS. 2-5 are designated with common numbers.

Figure 6:
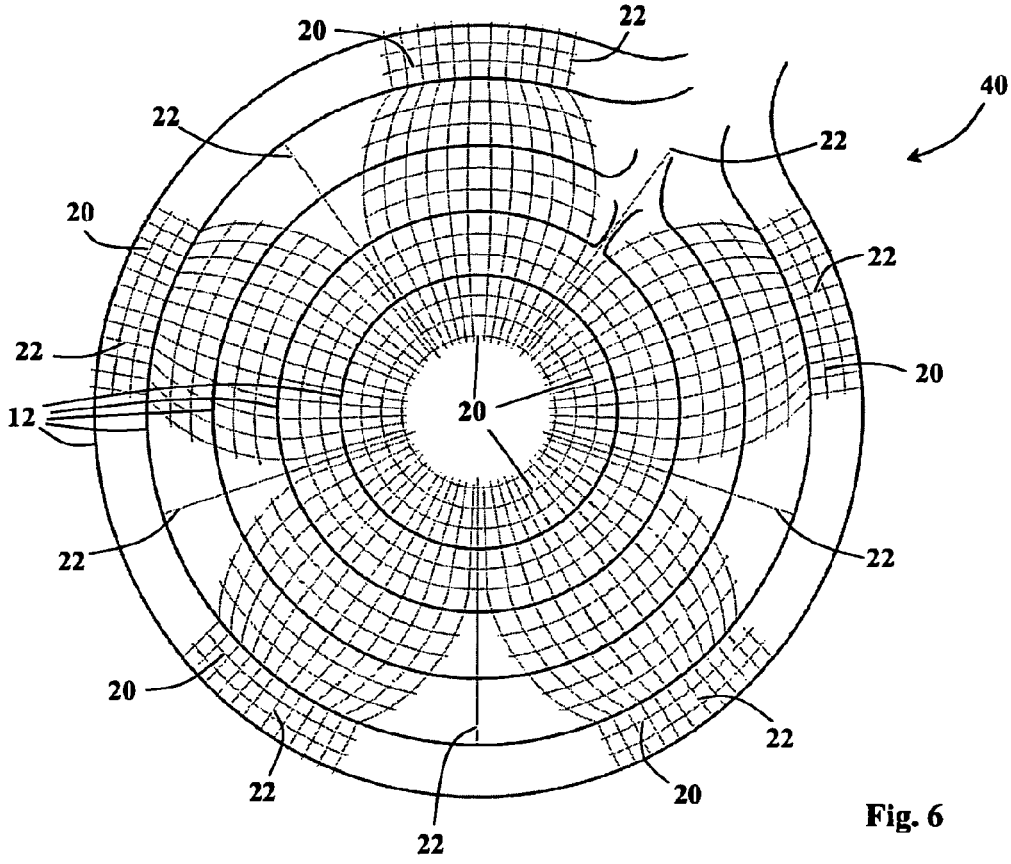
FIG. 6 is a plan view depicting one example of a generally flat embroidered structure containing multiple laces manufactured according to the process of FIG. 1.

FIG. 6 depicts an example of an embroidered structure 40 according to a first embodiment of the present invention. The embroidered structure 40 is shown by way of example as being generally flat, having a generally circular shape, and containing a series of laces 12 placed into the embroidery by the process of manufacture described above. The laces 12 are substituted for some of the stitching threads and soluble threads are substituted for the corresponding backing threads. The lace threads 12 and soluble threads are then stitched together forming temporary thread pairs while the remaining stitching threads and backing threads are stitched together forming a plurality of thread pairs 20. The thread pairs 20 and temporary thread pairs may then be enclosed by enclosing thread pairs 22 formed from enclosing stitching threads and enclosing backing threads. When the embroidering is completed, the soluble threads may be dissolved and the substrate may be removed. After dissolution of the soluble threads and removal of the substrate, the laces 12 will no longer be paired and will be free to move through the embroidered structure 10. Surrounding structures may be engineered to form eyelets for the laces 12 to run through.

Figure 7:
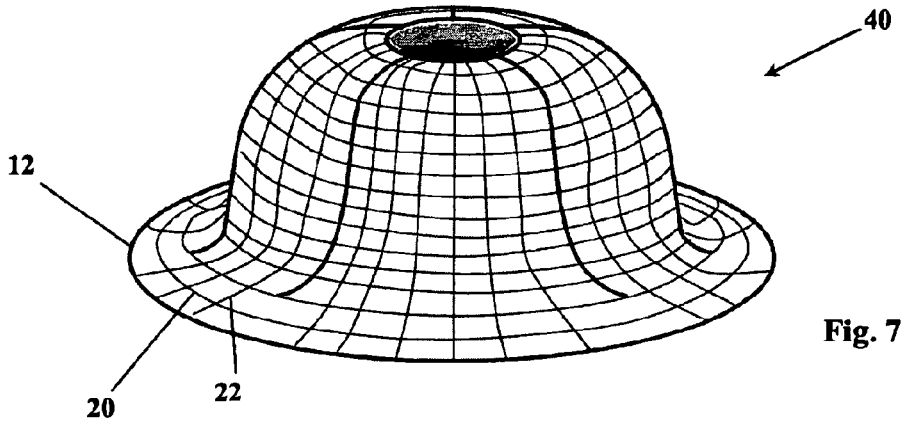
FIG. 7 is a perspective view of a three-dimensional curved embroidered structure formed by tensioning the laces of the embroidered structure shown in FIG. 6.

FIG. 7 illustrates the effect of tensioning the multiple laces 12 contained in the embroidered structure 40 from FIG. 6. Tensioning the laces 12 decreases the circumference of the generally circular path in which the laces 12 run around the fixed area of embroidered thread pairs 20 and enclosing thread pairs 22. This decreased circumference causes doming as the fixed area takes the three-dimensional shape due to the constraining of the fixed embroidered area within the decreased lace 12 circumference.

Figure 8:
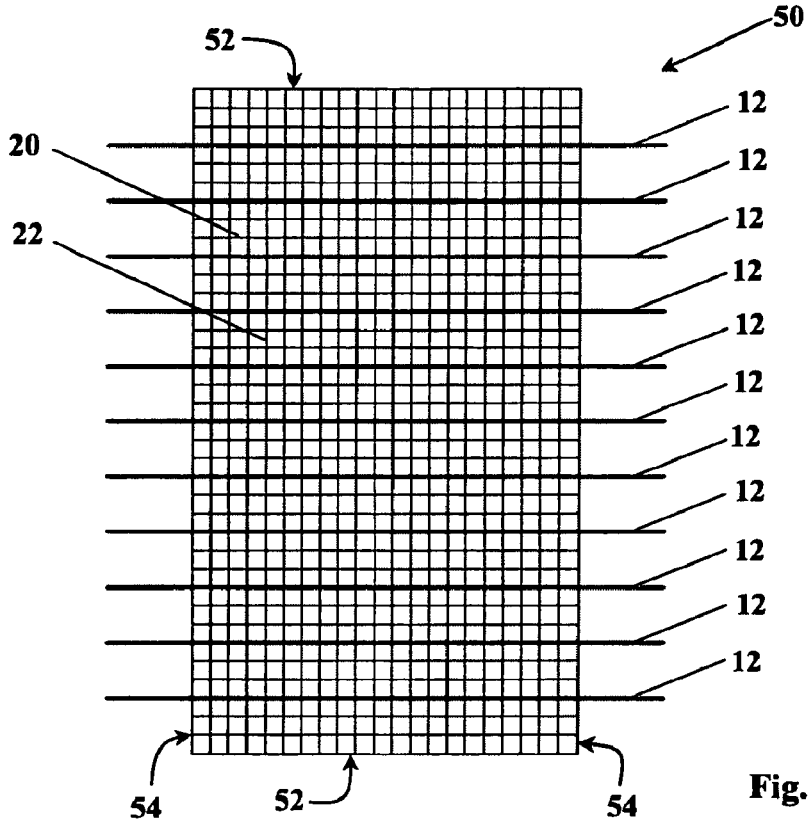
FIG. 8 is a plan view depicting a second example of a generally flat embroidered structure containing multiple laces manufactured according to the process of FIG. 1.

FIG. 8 depicts an example of an embroidered structure 50 according to a second embodiment of the present invention. The embroidered structure 50 is shown by way of example as being a generally flat, generally rectangular structure through which more than one lace 12 has been placed by the process of manufacture described above. The rectangular embroidered structure 50 necessarily has four edges; two shorter edges 52 and two longer edges 54. In this embodiment, the laces 12 run parallel to the two short edges 52 from one long edge 54 to the other long edge 54. Alternatively, the embroidered structure 50 could be arranged such that the laces 12 could run between short edges 54 parallel to the long edges 52, in which case the resulting cylindrical shape (see below) would be short and wide.

Figure 9:
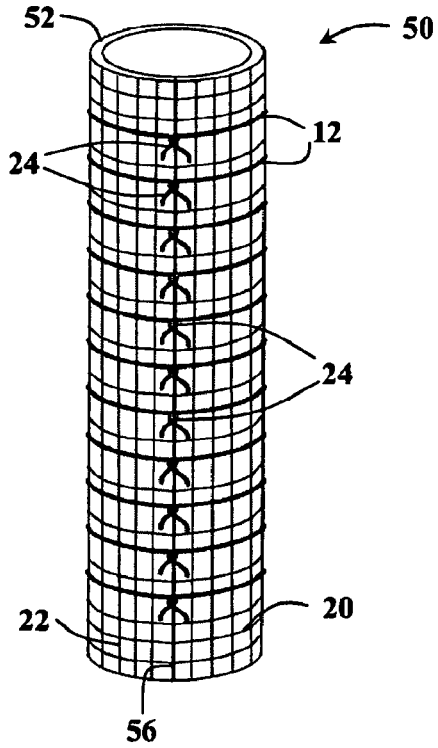
FIG. 9 is a perspective view of a generally cylindrical embroidered structure formed by tensioning and tying opposite ends of the laces of the embroidered structure shown in FIG. 8.

FIG. 9 illustrates the effect of tensioning and tying together the opposing ends of the laces 12 contained within the embroidered structure 50 from FIG. 8. The laces 12 as laid out in the embroidered structure 50 in FIG. 8 are generally flat, straight lines in the same plane as the stitched pairs 20 and enclosing pairs 22. When opposite ends of the laces 12 are brought together to make knots 24, the paths of the laces 12 becomes generally circular rather than linear, as in FIG. 8. Since the laces 12 are enclosed within the thread pairs 20 within the enclosing thread pairs 22, putting the laces 12 into circular paths also pulls the short edges 52 of the embroidered structure 50 into a generally circular shape while drawing together the opposing long edges 54 of the embroidered structure 50. Once the long edges 54 meet, the opposing ends of each lace 12 are tied together in knots 24 to secure the now cylindrical shape of the embroidered structure 50. In forming the cylindrical structure, the short edges 52 become generally circular and the long edges 54 meet to form a seam 56 which is parallel to the height aspect of the cylindrically shaped embroidered structure 50.

Figure 10:
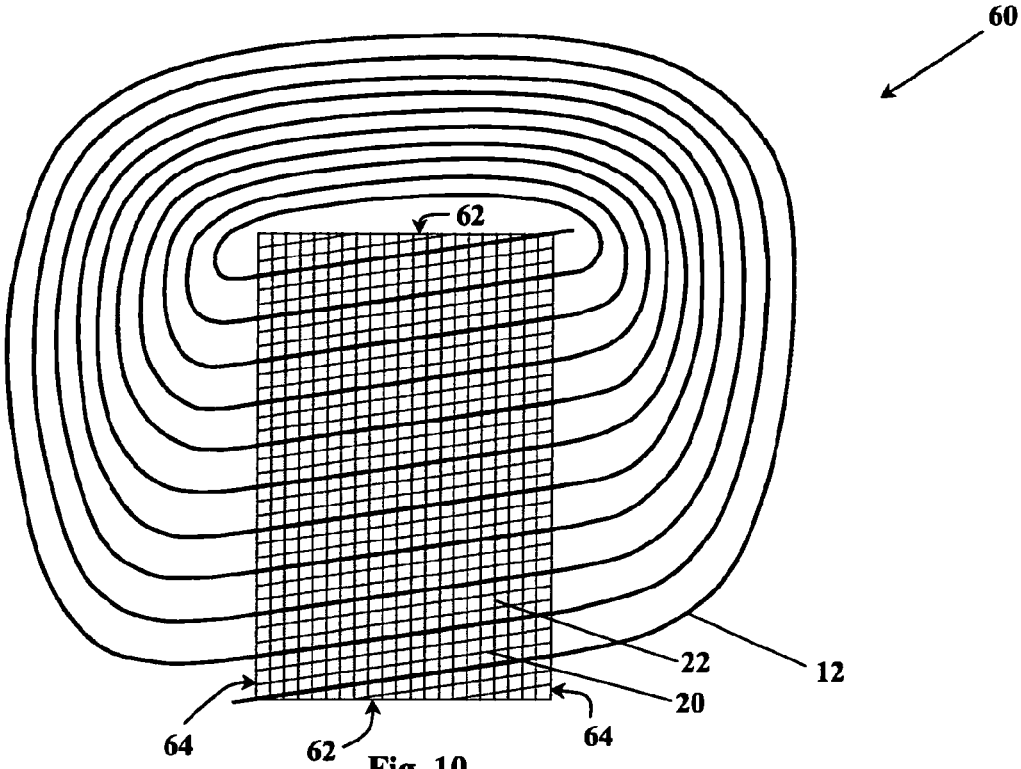
FIG. 10 is a plan view of a third example of a generally flat embroidered structure containing a single lace running through the embroidered structure multiple times manufactured according to the process of FIG. 1.

FIG. 10 depicts an example of an embroidered structure 60 according to a third embodiment of the present invention. The embroidered structure 60 is shown by way of example as being a generally flat, generally rectangular structure through which a single lace 12 was placed multiple times by the process of manufacture described above. The generally rectangular embroidered structure 60 necessarily has four edges; two short edges 62 and two long edges 64. In this embodiment, the lace 12 runs generally diagonally from one long edge 64 to the other long edge 64, then around the outside of the embroidered structure 60 and back to the first long edge 64 where it enters the embroidered structure again. In an alternative embodiment, the lace 12 could be run between the short edges 62 to result in a differently dimensioned structure than the one described below.

Figure 11:
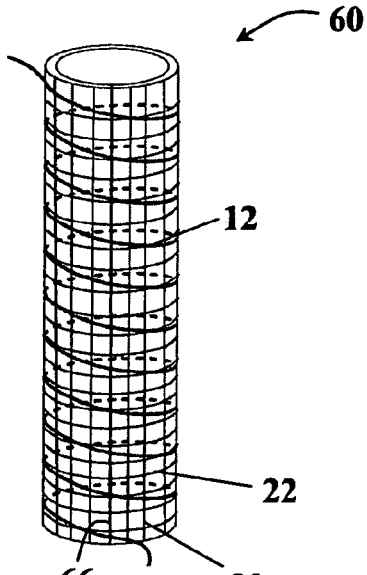
FIG. 11 is a perspective view of a generally cylindrical embroidered structure formed by tensioning the lace of the embroidered structure shown in FIG. 10.

As shown in FIG. 11, a three-dimensional, generally cylindrical embroidered structure 60 may be formed by tensioning the lace 12 of the embroidered structure 60 shown in FIG. 10. The lace 12 is laid out in the shape of a flat spiral in FIG. 10, but as the lace 12 is tensioned, the radii of the spiral loops of the lace 12 begin to decrease until the two-dimensional lace 12 spiral takes the shape of a three-dimensional helix. Since the lace 12 is enclosed within the thread pairs 20 within the enclosing thread pairs 22, putting the lace 12 in a helical shape causes the embroidered structure 10 enclosing it to curl around the axis of the spiral path of the lace 12. The curling causes the long edges 64 of the embroidered structure 10 to come closer together such that the edges will eventually meet. Once the long edges 64 meet, the embroidered structure 60 is in the general shape of a cylinder with the long edges 64 forming a seam 66 parallel to the axis of the helix and the height aspect of the cylinder.

Figure 12:
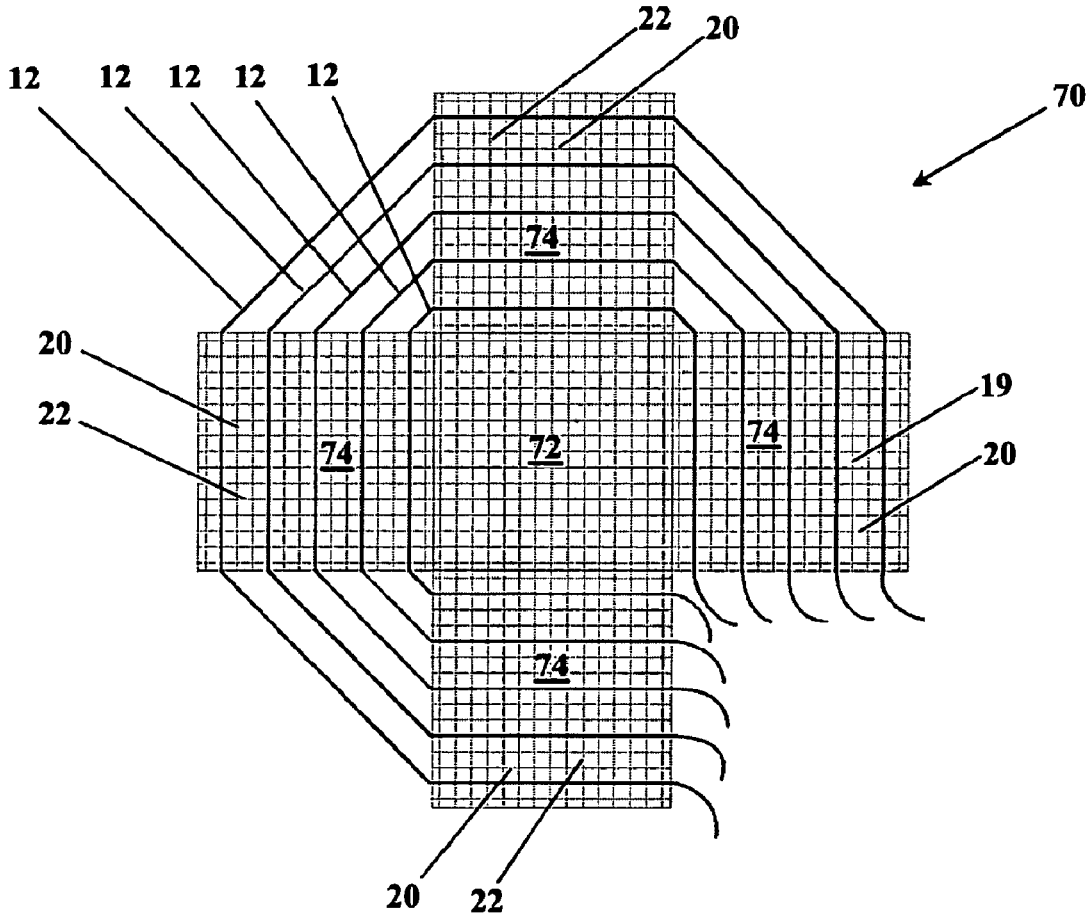
FIG. 12 is a plan view of a fourth example of a generally flat embroidered structure containing multiple laces manufactured according to the process of FIG. 1.

FIG. 12 depicts an example of an embroidered structure 70 according to a fourth embodiment of the present invention. The embroidered structure 70 is shown by way of example as being a generally flat, polygonal shaped structure through which several laces 12 are placed by the process of manufacture described above. The polygon may have a central panel 72 which shares each of its sides with one of four outer panels 74. The laces 12 are run through each of the outer panels 74 without running through the central panel 72, such that the lace 12 runs through one outer panel 74, then through open space 76, then through another outer panel 74, then through open space 76 and so on until the two ends of each lace 12 occupy the same open space 76. In the example shown in FIG. 12, the central panel 72 and outer panels 74 are all square shaped, and thus are dimensionally identical to one another. However, it is contemplated that any variety of complementary polygonal shapes and configurations may be used, such as for example a generally rectangular central panel 72 in combination with a pair of opposing generally rectangular outer panels 72 and a pair or opposing generally square outer panels 72. Such a configuration would result in a generally rectangular box shape upon tensioning of the laces 12 (as described below). Further embodiments may include combinations of triangles, quadrilaterals, pentagons, hexagons, etc.

Figure 13:
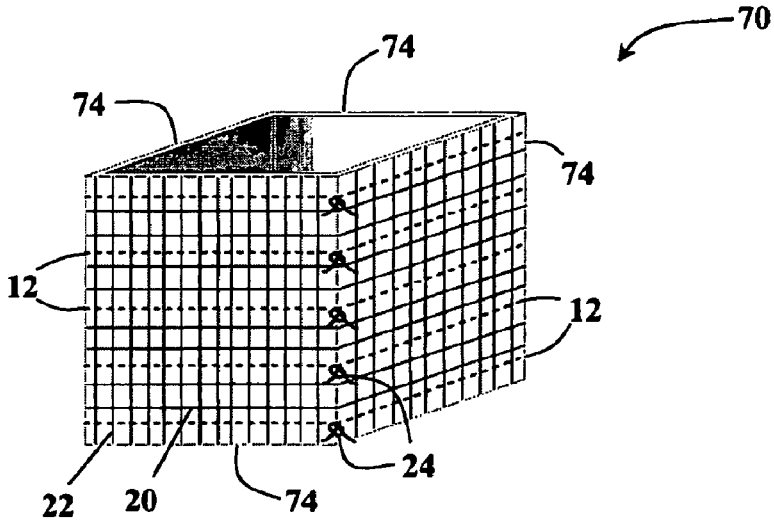
FIG. 13 is a perspective view of a polygonal-shaped embroidered structure, with one side open, formed by tying opposite ends of the laces of the embroidered structure in FIG. 12.

As shown in FIG. 13, a three-dimensional polyhedron open box-shaped embroidered structure 70 may be formed by tensioning the laces 12 shown in FIG. 12. Tensioning the laces 12 pulls the length of each lace 12 from the open space 76 between outer panels 74, which in turn draws the edges of the outer panels 74 together. When all the length of laces 12 between the outer panels 74 has been pulled through the outer panels 74, the edges of the polygonal embroidered structure 70 unite such that a polyhedron shaped embroidered structure 70 with one open side is formed. Tying the opposite ends of the laces 12 in knots 24 secures the shape of the embroidered structure 70.

Figure 14:
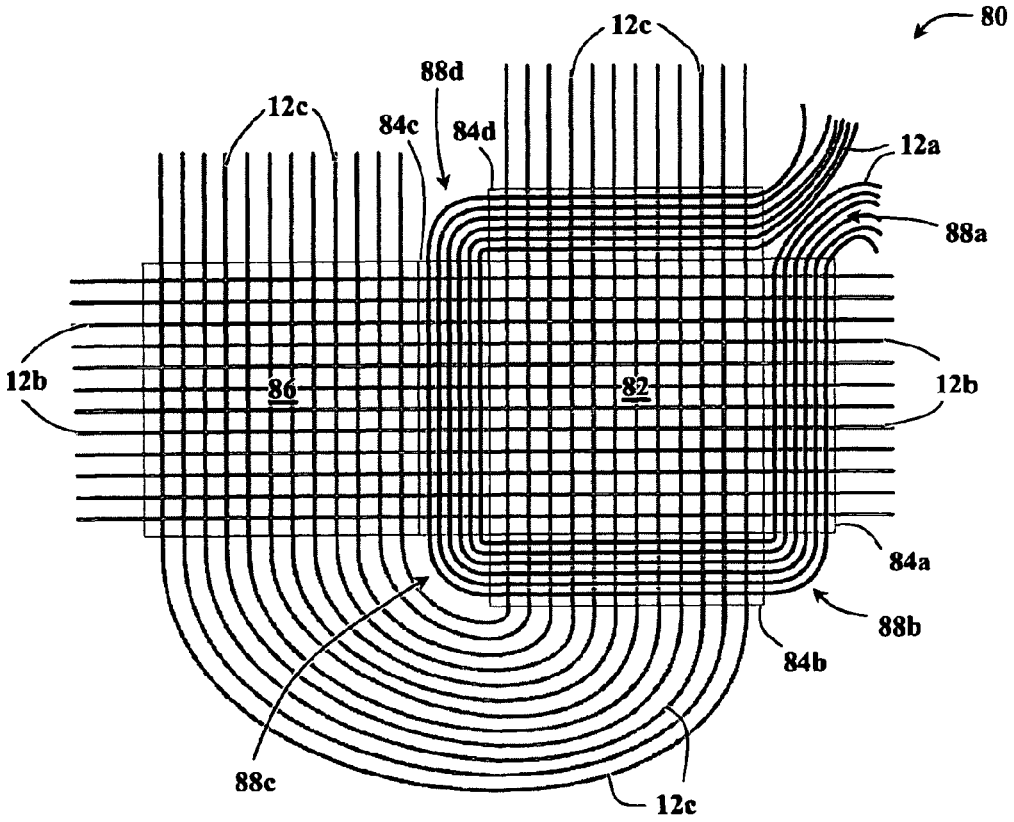
FIG. 14 is a plan view of a fifth example of a generally flat embroidered structure containing multiple laces manufactured according to the process of FIG. 1.

FIG. 14 depicts an example of an embroidered structure 80 according to a fifth embodiment of the present invention. The embroidered structure 80 is shown by way of example as being a generally flat, polygonal-shaped structure enclosing a series of laces 12 placed therein by the process of manufacture described above. The polygonal shape may have a first major panel 82 which shares each of its sides with one side of each of four minor panels 84*a*, 84*b*, 84*c*, and 84*d*. In the example shown, each of the four minor panels 84*a-d* is the same height, and has a length defined by the side it shares with the first major panel 82. Minor panel 84*c* is positioned between the first major panel 82 and a second major panel 86, in that the minor panel 84*c* shares one length-defining side with the first major panel 84 and a second, identical length-defining side with the second major panel 86. By way of example only, the second major panel 86 is identically dimensioned relative to the first major panel 82. The laces 12 are distributed in three ways. The laces 12*a* run lengthwise successively through the four minor panels 84*a-d*. The laces 12*a* originate in a first open space 88*a*, pass through the first minor panel 84*a* in a lengthwise direction and into a second open space 88*b*. This path continues in succession through minor panel 84*b*, open space 88*c*, minor panel 84*c*, open space 88*d*, and minor panel 84*d* until the laces 12*a* emerge within open space 88*a* at which point both ends of each lace 12*a* are in the same open space. The laces 12*b* pass into the second major panel 86, straight through the minor panel 84*c* (and generally perpendicular to the laces 12*a* therein), through the first major panel 82 and out the end of the polygon through the minor panel 84*a* (and generally perpendicular to the laces 12*a* therein). Laces 12*c* follow a generally horseshoe-shaped path, for example entering minor panel 84*d* and passing through such that laces 12*c* are generally perpendicular to laces 12*a* within minor panel 84*d*. Laces 12*c* continue through major panel 82 (such that laces 12*c* are generally perpendicular to laces 12*b* within major panel 82) and through the minor panel 84*b* (also such that laces 12*c* are generally perpendicular to laces 12*a* within minor panel 84*b*). Upon exiting minor panel 84*b*, laces 12*c* curve back to the polygon to pass through the major panel 86 in a direction generally parallel to the laces 12*c* within major panel 82 and generally perpendicular to laces 12*b* within major panel 86. Surrounding structures may be engineered to form eyelets for the laces 12*a-c* to run through.

Figure 15:
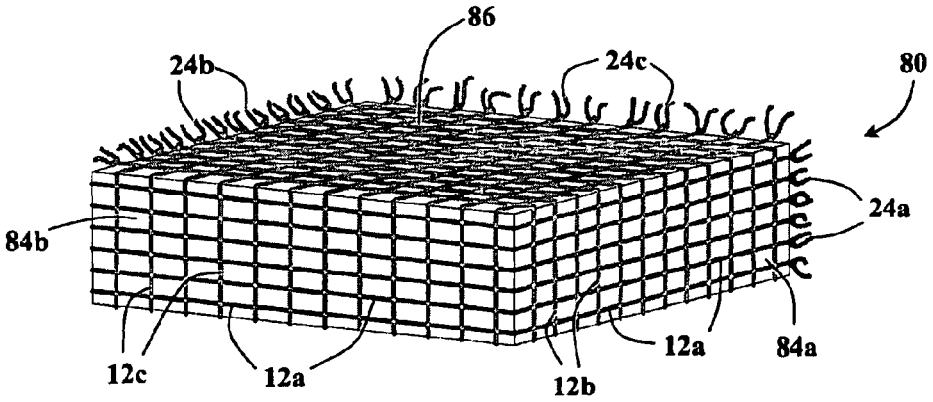
FIG. 15 is a perspective view of a closed polygonal-shaped embroidered structure formed by tying opposite ends of the laces of the embroidered structure in FIG. 14.

FIG. 15 shows the three-dimensional embroidered hexahedron structure 80 created by tensioning and tying the opposite ends of each laces 12*a-c* from FIG. 14. Upon tensioning the laces 12*a*, the length of lace 12*a* in the open spaces 88*a-d* shorten, which in turn pulls the edges of the minor panels 84*a-d* together. When all the length of lace 12*a* between the minor panels 84*a-d* has been pulled through the minor panels 84*a-d*, the edges of the polygonal embroidered structure 80 unite to form a polyhedron-shaped embroidered structure 80 with one open side, and with the major panel 86 attached to an edge of the open side of the polyhedron (minor panel 84*c*). Tying the opposite ends of the laces 12*a* in knots 24*a* secures the shape of the embroidered structure 80. Tensioning and tying laces 12*b* into knots 24*b* draws the major panel 86 on top of the open side, thus closing the open box structure by adding the sixth side necessary to have a closed hexahedron. Tensioning and tying laces 12*c* into knots 24*c* secures the last remaining unfixed edge of the closed hexahedron.

Figure 16:
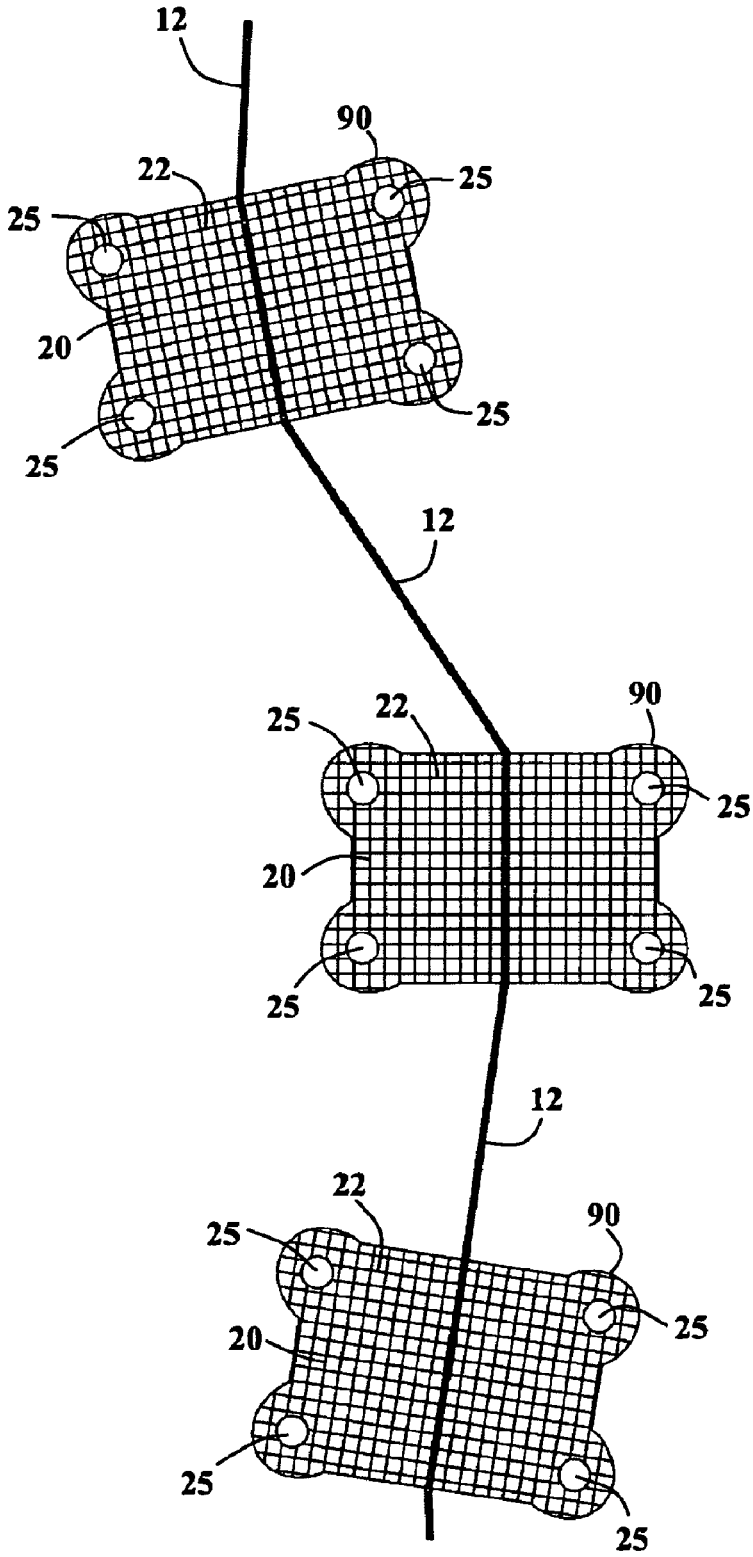
FIG. 16 is a plan view of a system manufactured according to the process of FIG. 1, including a series of individual embroidered structures which act as anchors for one or more laces running through the series of embroidered structures according to one embodiment of the present invention.

FIG. 16 depicts a set of generally flat embroidered structures 90 according to a sixth embodiment of the present invention, used to anchor and guide a lace 12 which runs through each of the embroidered structures 90. The process for manufacturing the embroidered structure 90 is described above. The completed embroidered structures 90 may be affixed to a surface or surfaces using the fastener holes 25 to facilitate mechanical attachment between each embroidered structure 90 and the surface to which it is joined. Once in place, the embroidered structures 90 act as anchors and guide the lace 12 as it is pulled through the embroidered structures 90. The predictability of the path of the lace 12 allows for the lace 12 to be protected from fouling on surrounding objects and protects surrounding objects from being damaged or disturbed through contact with the lace 12.

Figure 17:
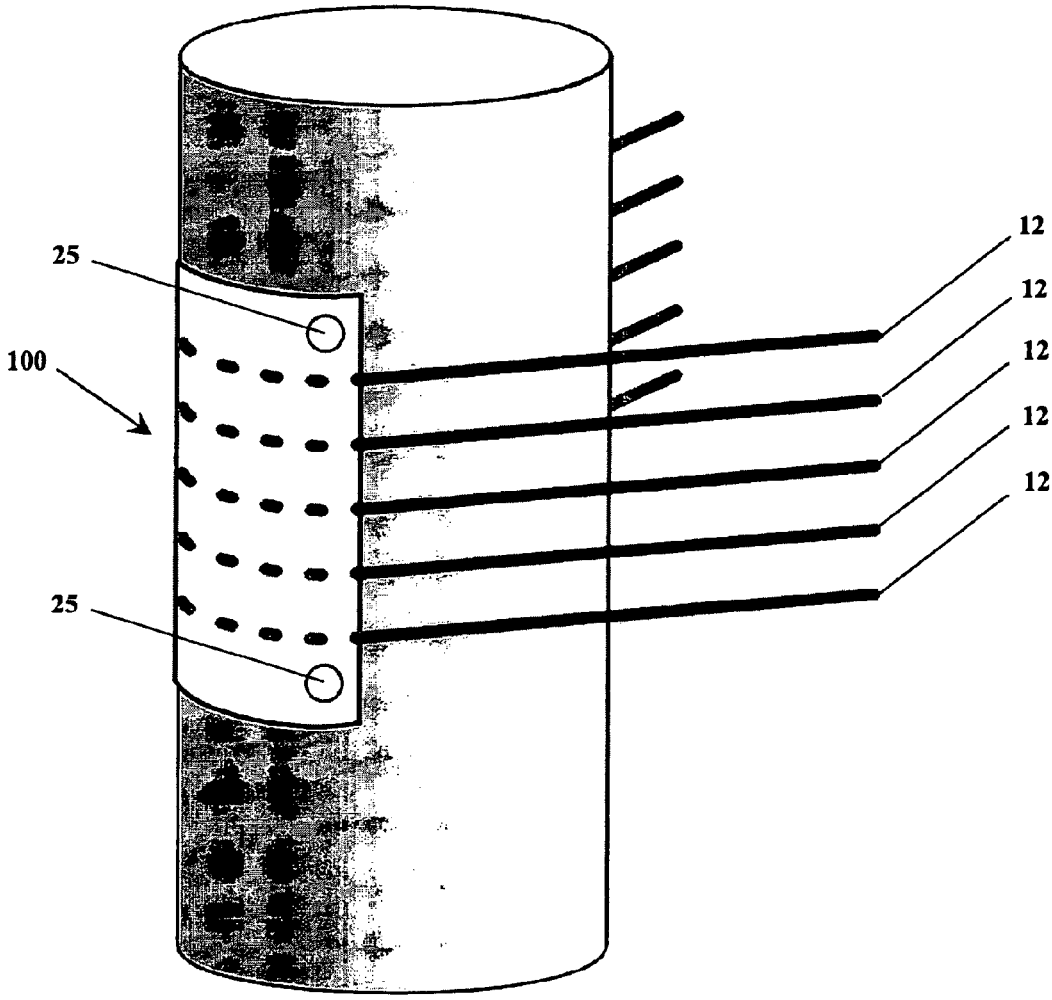
FIG. 17 is a perspective view of an embroidered structure manufactured according to the process of FIG. 1, through which one or more laces are guided and thus prevented from crossing each other while being positioned along the curve of an object according to one embodiment of the present invention.

FIG. 17 shows a generally flat embroidered structure 100 according to a seventh embodiment of the present invention. The embroidered structure 100 has a generally rectangular shape and is used to guide laces 12 in a predictable path around an object. The process for manufacturing the embroidered structure 100 is described above. The completed embroidered structure 100 may be affixed to a surface using the fastener holes 25 to facilitate mechanical attachment between the embroidered structure 100 and the surface to which it is joined. The embroidered structure 100 allows the laces 12 to be guided in a predictable path when positioned partially around an object, such as a generally cylindrical, generally polyhedral or object of some other shape. This guided running prevents the laces 12 from crossing, which would inhibit their freedom of movement. Surrounding structures may be engineered to form eyelets for the laces 12 to run through.

Figure 18:
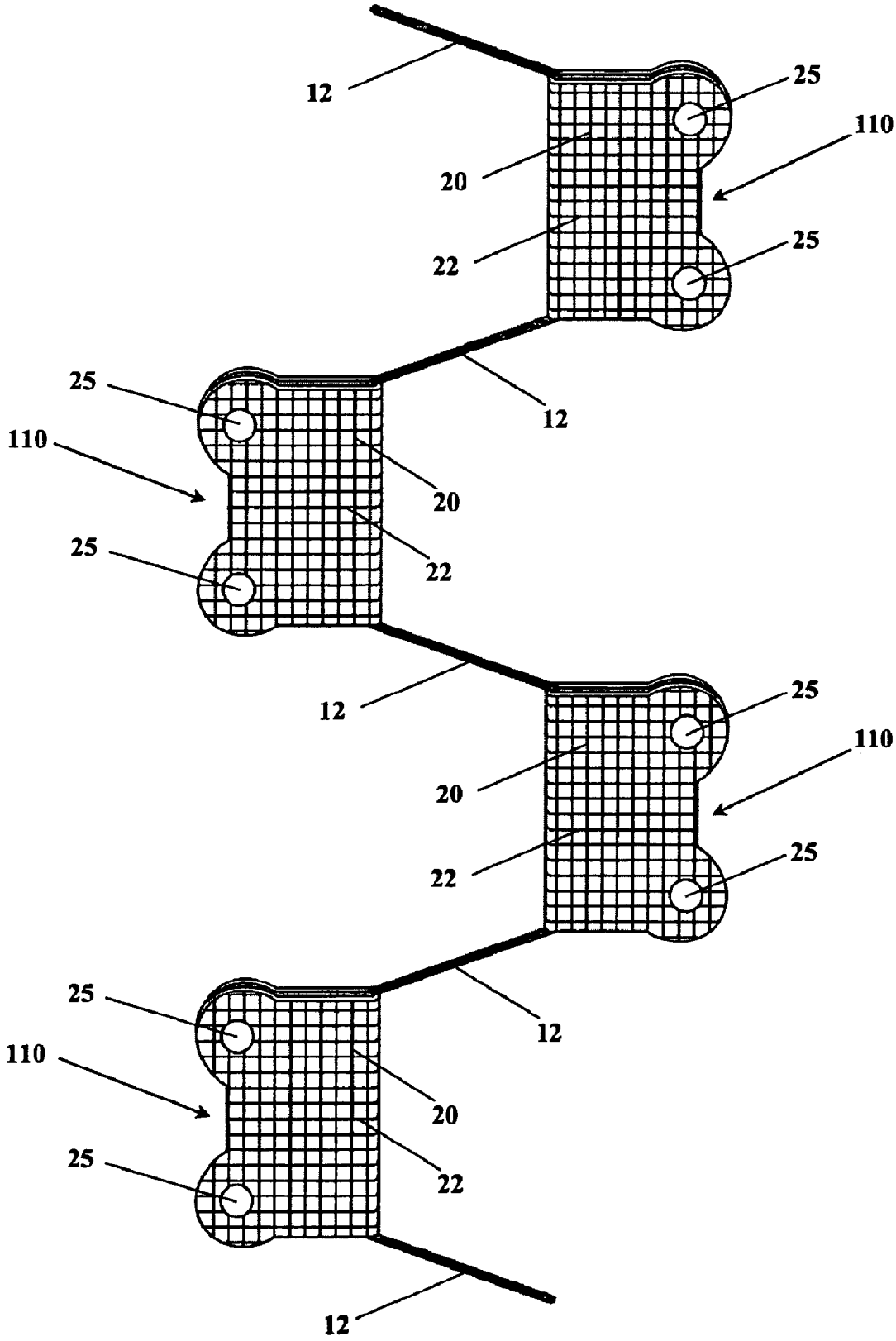
FIG. 18 is a plan view of a system manufactured by the process of FIG. 1, including a series of embroidered structures with a single, integral lace running through each which, upon tensioning, causes the inwardly facing side surfaces of the embroidered structures to pull into a uniform line according to one embodiment of the present invention.

FIG. 18 shows a set of generally flat embroidered structures 110 according to an eighth embodiment of the present invention, used to reproducibly position objects in a line. The process for manufacturing the embroidered structure 110 is described above. The embroidered structures 110 are generally rectangular, and may have one or more fastener holes 25. A single, integral lace 12 runs through all of the embroidered structures 10, and may run through the embroidered structures 12 either close to the facing sides, over the fastener holes 25 along the periphery opposite the facing sides or at any position there between. The completed embroidered structures 110 may each be affixed to an object using the fastener holes 25 to facilitate mechanical attachment between each embroidered structure 110 and the object to which it is joined. Once the embroidered structures are attached to objects, tensioning the lace 12 by pulling its ends in opposite directions will cause the lace 12 to straighten. As the lace 12 straightens, it will pull the embroidered structures 110, and the objects to which they are attached, into a line defined by the directions in which the two ends of the lace 12 are pulled.

Figure 19:
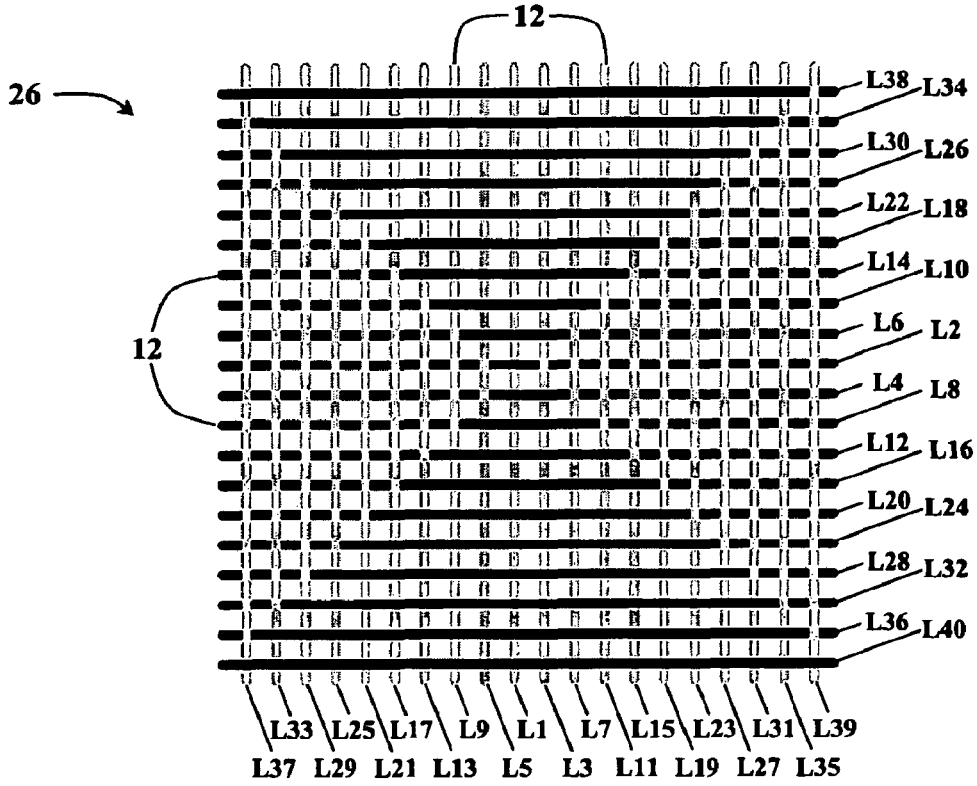
FIG. 19 is a plan view of an embroidered structure, manufactured according to the process of FIG. 1, in which laces are interlaced in a honeycomb pattern according to one exemplary aspect of the invention.

FIG. 19 depicts a woven structure 26 according to one aspect of the present invention, created from laces 12 using the embroidery techniques of the present invention. Each of the woven laces 12, individually numbered L1-L40, is laid down by stitching to a corresponding soluble thread on a substrate, forming temporary thread pairs. When all of the laces 12 are stitched to corresponding soluble threads, there is an embroidered structure of temporary thread pairs on the substrate. The soluble threads may then be dissolved and substrate may be removed. After dissolution of the soluble thread and substrate, the pairing of the soluble thread with the lace thread 12 is destroyed. As there are no longer any paired threads, but instead only interwoven laces 12 holding each other in the woven structure 26. The dissolution of the soluble thread and substrate turn what is created as an embroidered structure into a woven structure 26.

The woven structure 26 is exemplary of the use of the embroidering techniques of the present invention to create non-embroidered finished products. The extent of these non-embroidered products is not limited to those which are woven, but includes all other methods of creating structures from filamentary materials. The finished products may be completely non-embroidered or a hybrid of embroidery and one or more other techniques including, but not limited to, weaving.

Woven structures may also take many shapes. For example, the woven structure 26 from FIG. 19 is created by embroidering in the following order and positions:

| Lace Number and Stitching Order | Orientation | Location |
|---|---|---|
| L1 | Vertical | Centered |
| L2 | Horizontal | Centered |
| L3 | Vertical | Right of L1 |
| L4 | Horizontal | Below L2 |
| L5 | Vertical | Left of L1 |
| L6 | Horizontal | Above L2 |
| L7 | Vertical | Right of L3 |
| L8 | Horizontal | Below L4 |
| L9 | Vertical | Left of L5 |
| L10 | Horizontal | Above L6 |
| L11 | Vertical | Right of L7 |
| L12 | Horizontal | Below L8 |
| L13 | Vertical | Left of L9 |
| L14 | Horizontal | Above L10 |
| L15 | Vertical | Right of L11 |
| L16 | Horizontal | Below L12 |
| L17 | Vertical | Left of L13 |
| L18 | Horizontal | Above L14 |
| L19 | Vertical | Right of L15 |
| L20 | Horizontal | Below L16 |
| L21 | Vertical | Left of L17 |
| L22 | Horizontal | Above L18 |
| L23 | Vertical | Right of L20 |
| L24 | Horizontal | Below L30 |
| L25 | Vertical | Left of L21 |
| L26 | Horizontal | Above L22 |
| L27 | Vertical | Right of L23 |
| L28 | Horizontal | Below L24 |
| L29 | Vertical | Left of L25 |
| L30 | Horizontal | Above L26 |
| L31 | Vertical | Right of L27 |
| L32 | Horizontal | Below L28 |
| L33 | Vertical | Left of L29 |
| L34 | Horizontal | Above L30 |
| L35 | Vertical | Right of L31 |
| L36 | Horizontal | Below L32 |
| L37 | Vertical | Left of L33 |
| L38 | Horizontal | Above L34 |
| L39 | Vertical | Right of L35 |
| L40 | Horizontal | Below L36 |

This order and position creates a honeycomb-shaped woven structure 26. However, different weaving effects give structures different properties, including but not limited to flexibility and feel.

Figure 20:
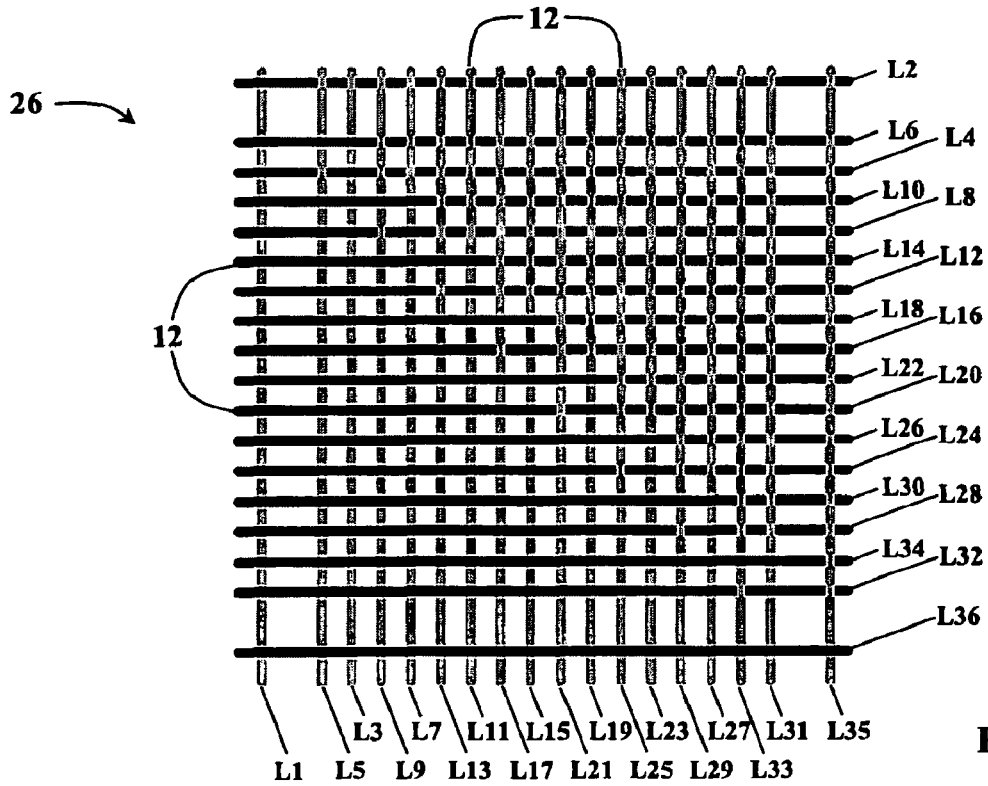
FIG. 20 is a plan view of an embroidered structure, manufactured according to the process of FIG. 1, in which laces are interlaced in a diagonal weave pattern according to another exemplary aspect of the invention.

FIG. 20 depicts a woven structure 26 created by the same process as the woven structure in FIG. 19, differing only in the number, order, and position of the laces 12 (individually numbered L1-L36). The woven structure 26 in FIG. 20 is woven in the following order and positions:

| Lace Number and Stitching Order | Orientation | Location |
|---|---|---|
| L1 | Vertical | Left Edge |
| L2 | Horizontal | Top Edge |
| L3 | Vertical | Right of L1 |
| L4 | Horizontal | Below L2 |
| L5 | Vertical | Btw L1 & L3 |
| L6 | Horizontal | Btw L2 & L4 |
| L7 | Vertical | Right of L3 |
| L8 | Horizontal | Below L4 |
| L9 | Vertical | Between L3 & L7 |

-continued

| Lace Number and Stitching Order | Orientation | Location |
|---|---|---|
| L10 | Horizontal | Between L4 & L8 |
| L11 | Vertical | Right of L7 |
| L12 | Horizontal | Below L8 |
| L13 | Vertical | Between L7 & L11 |
| L14 | Horizontal | Between L8 & L12 |
| L15 | Vertical | Right of L11 |
| L16 | Horizontal | Below L12 |
| L17 | Vertical | Between L11 & L13 |
| L18 | Horizontal | Between L12 & L16 |
| L19 | Vertical | Right of L15 |
| L20 | Horizontal | Below L16 |
| L21 | Vertical | Between L15 & L20 |
| L22 | Horizontal | Between L16 & L30 |
| L23 | Vertical | Right of L20 |
| L24 | Horizontal | Below L30 |
| L25 | Vertical | Between L20 & L23 |
| L26 | Horizontal | Between L30 & L24 |
| L27 | Vertical | Right of L23 |
| L28 | Horizontal | Below L24 |
| L29 | Vertical | Between L23 & L27 |
| L30 | Horizontal | Between L24 & L28 |
| L31 | Vertical | Right of L27 |
| L32 | Horizontal | Below L28 |
| L33 | Vertical | Between L27 & L31 |
| L34 | Horizontal | Between L28 & L32 |
| L35 | Vertical | Right of L31 |
| L36 | Horizontal | Below L32 |

After dissolution of the soluble thread and substrate, this order and position creates a diagonal weave throughout the woven structure 26. This weave will have different characteristics, including but not limited to flexibility and feel, than that of the woven structure 26 in FIG. 19. The patterns from FIG. 19 and FIG. 20 are merely examples of the numerous patterns possible from interlacing by the process of the present invention.

Figure 21:
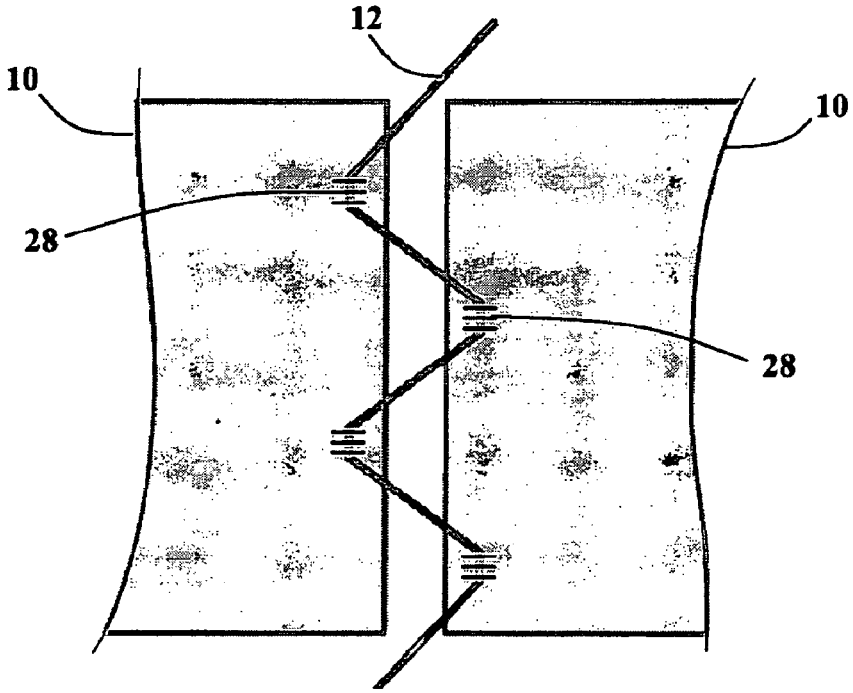
FIG. 21 is a plan view of a pair of embroidered structures, manufactured according to the process of FIG. 1, which are connected by a single, preloaded lace according to one embodiment of the present invention.

FIG. 21 shows a pair of embroidered structures 10 separated by a seam preloaded with one lace 12 according one example of a ninth embodiment of the present invention. The process for manufacturing the embroidered structure 10 is described above. During the embroidery process of the present invention, a lace 12 is stitched to a soluble thread such that the temporary thread pair zigzags between the pair of embroidered structures 10. Eyelet threads 28 are then sewn around the lace 12 and soluble thread on each of the embroidered structures 10. The soluble thread and substrate are then dissolved. The two embroidered structures 10 are now independent of each other, and the lace 12, no longer a part of a temporary thread pair after dissolution of the soluble thread, is free to run through the eyelet threads 28 between the two embroidered structures 10.

Figure 22:
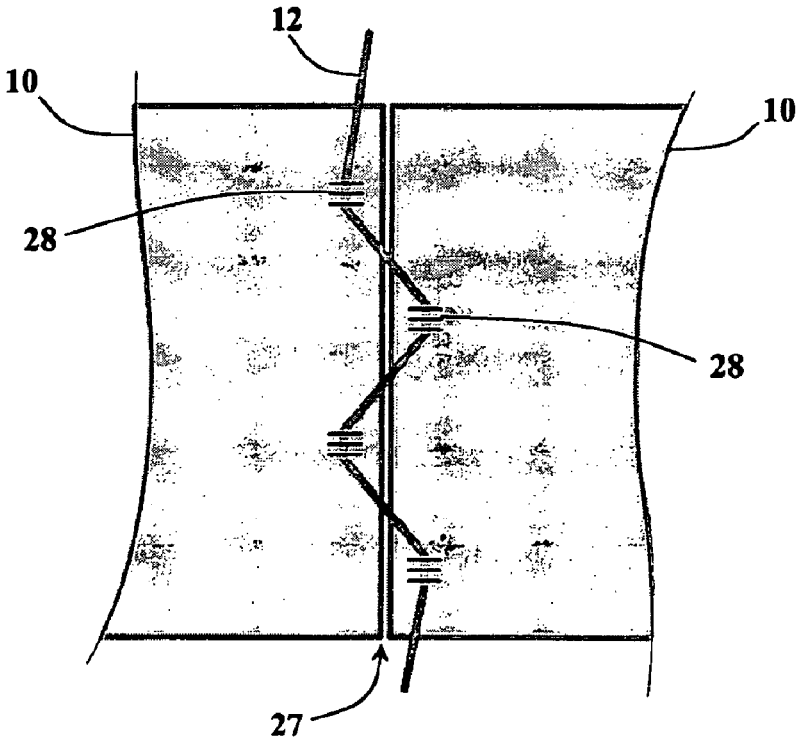
FIG. 22 is a plan view of the pair of embroidered structures of FIG. 21, showing in particular that the seam of the embroidered structure in FIG. 21 may be used to reproducibly unite objects (not shown) connected to the embroidered structures upon tensioning of the lace according to one embodiment of the present invention.

FIG. 22 illustrates the result of tensioning the lace 12 between the embroidered structures 10 in FIG. 21. When tensioned, the lace 12 will pull into as straight a line as possible. This straightening imparts a force from the lace 12 onto the embroidered structures 10, drawing the embroidered structures 10 closer together along the seam 27 separating them. When the embroidered structures 10 are attached to two or more objects, this embodiment provides a manner in which the attached objects may be united in a highly consistent, repeatable manner.

Figure 23:
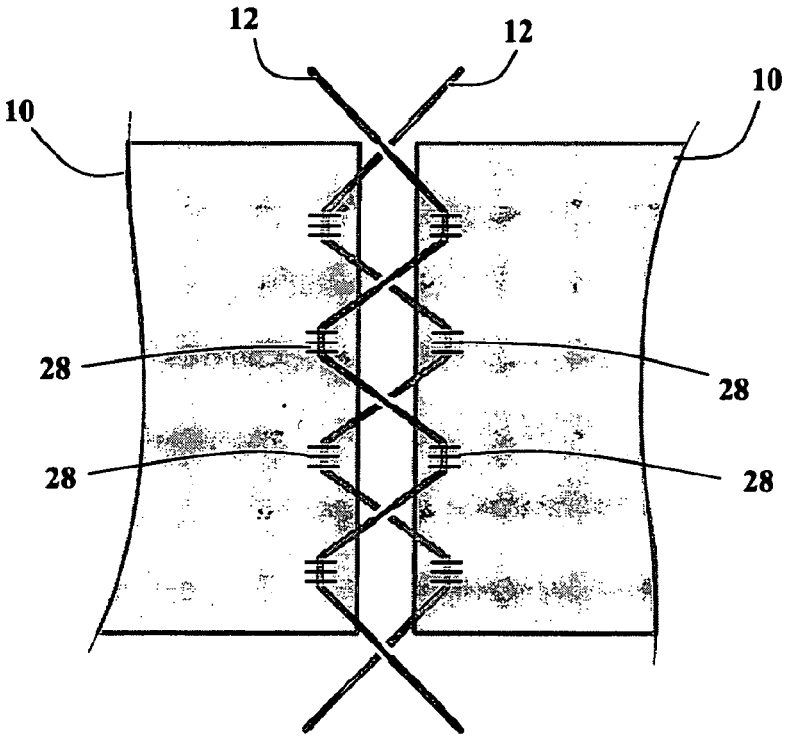
FIG. 23 is a plan view of a pair of embroidered structures, manufactured according to the process of FIG. 1, which are connected by two or more preloaded laces, according to one embodiment of the present invention.

FIG. 23 shows a pair of embroidered structures 10 separated by a seam preloaded with more than one lace 12 by the process of the present invention. After the embroidered structures are created according to the process described in the explanation of FIG. 21 above, two or more laces 12 are stitched to soluble threads such that the temporary thread pairs zigzag between the pair of embroidered structures 10, one mirroring the path of the other. Eyelet threads 28 are then sewn around the laces 12 and soluble threads on each of the embroidered structures 10. The soluble threads and substrate are then dissolved. The two embroidered structures 10 are now independent of each other and the laces 12, no longer a part of temporary thread pairs after dissolution of the soluble threads, are free to run through the eyelet threads 28 between the two embroidered structures 10.

Figure 24:
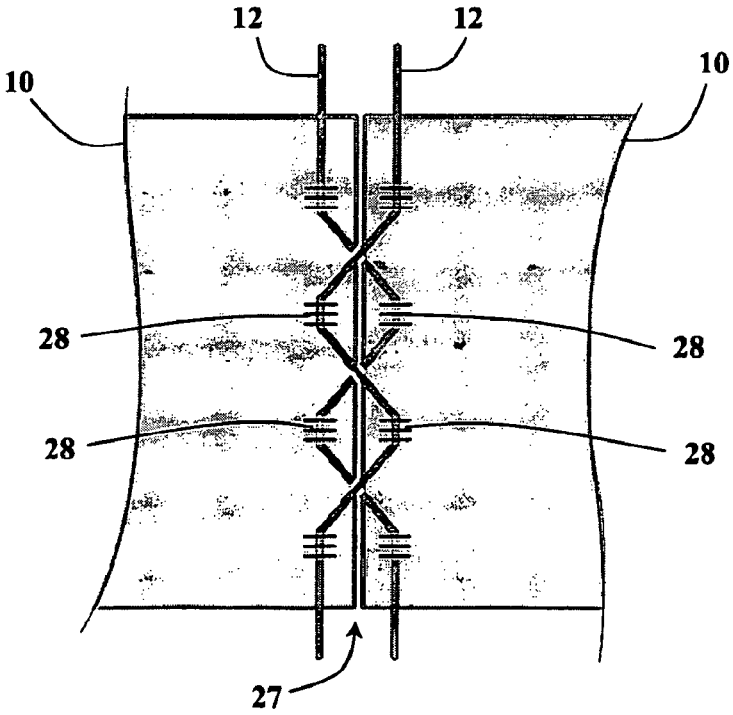
FIG. 24 is a plan view of the pair of embroidered structures of FIG. 23, showing in particular that the seam of the embroidered structure in FIG. 23 may be used to reproducibly unite objects (not shown) connected to the embroidered structures upon tensioning of the laces according to one embodiment of the present invention.

FIG. 24 illustrates the result of tensioning the laces 12 between the embroidered structures 10 in FIG. 23. As in the single lace version in FIG. 22 above, the tensioned laces 12 will pull into as straight a line as possible. This imparts a force from the laces onto the embroidered structures 10, drawing them closer together along the seam 27 separating them. When the embroidered structures 10 are attached to two or more objects, this embodiment provides a manner in which the attached objects may be united in a highly consistent, repeatable manner.

Figure 25:
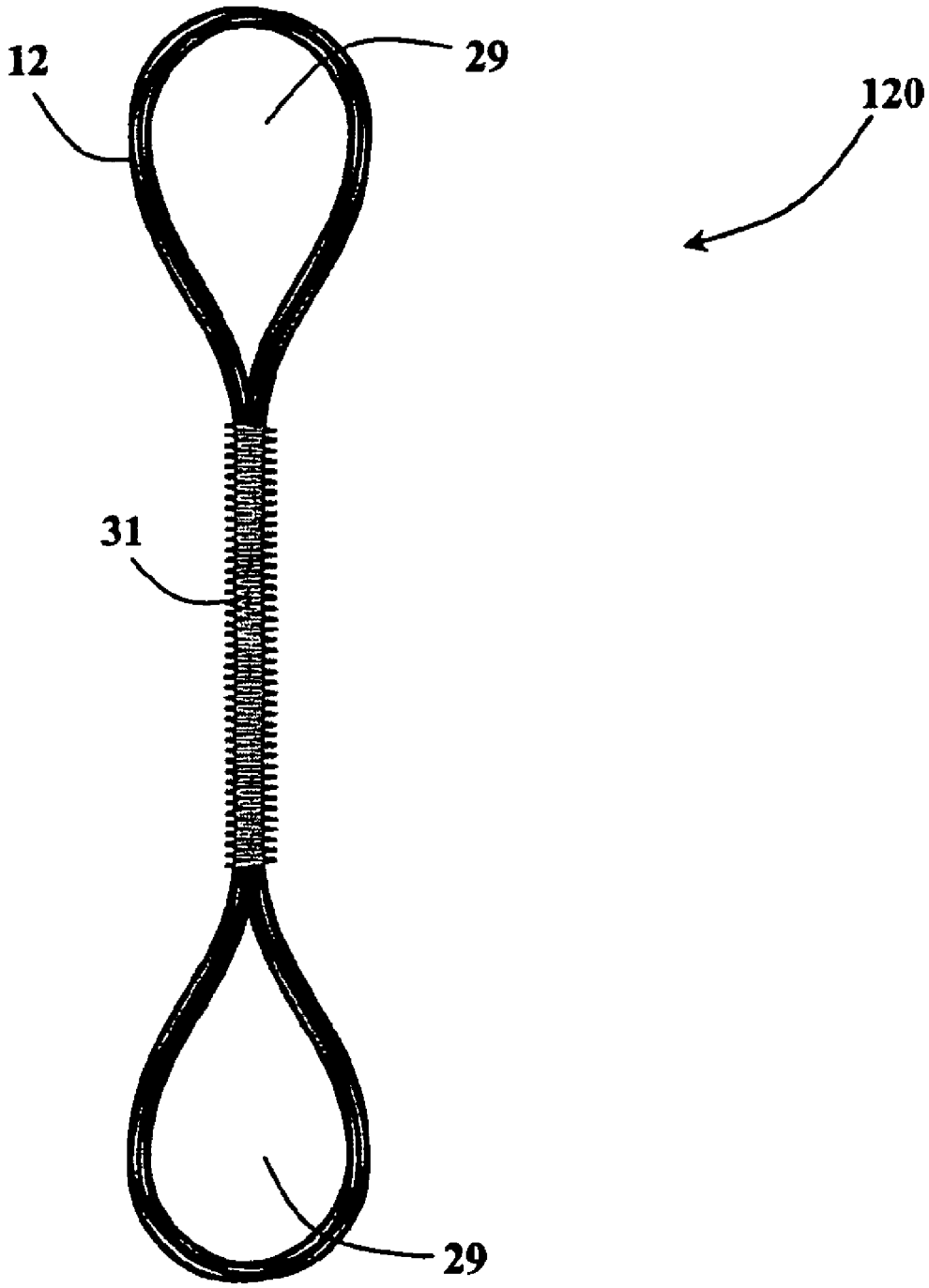
FIG. 25 is a plan view of a load bearing strap manufactured according to the process of FIG. 1.

FIG. 25 shows an embroidered structure 10 manufactured according to one embodiment of the present invention in the form of a load bearing structure. During the embroidery process of the present invention, the lace 12 is stitched to a soluble thread on a substrate. The whipping thread 31 is then stitched around the lace 12 and soluble thread such that the whipping thread 31 will hold the stem of the embroidered structure 10 together. The dissolution of the soluble threads and dissolvable substrate may be performed once the stitching of the embroidered structure 10 has been completed. After dissolution, the embroidered structure 10 may be used as a load bearing device such as by coupling the resulting loops 29 between two structures or two regions within a single structure. The use of the embroidery techniques in the production of the embroidered structure 10 ensures the uniformity of the free loops 29 and the equalized length of the lace 12, thus improving the consistency of performance of embroidered structures 10 through the repeatability of its manufacture.

As evidenced above, the present invention overcomes, or at least minimizes, the drawbacks of the prior art. The devices described herein may be repeatably mass produced based on the automated nature of the embroidery process of the present invention. Embroidery with one soluble thread allows for a single, unpaired lace to be laid down reliably, cost effectively, and in a manner conducive to mass production.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined herein.

What is claimed is:

1. A method of manufacturing an embroidered structure having at least one embedded lace element, comprising:

providing a substrate having a stitching surface and a backing surface, a plurality of stitching threads, and a plurality of backing threads secured to said backing surface and corresponding to said plurality of stitching threads, at least one of said stitching threads and backing threads comprising a lace thread and at least one of said stitching threads and said backing threads comprising a soluble thread corresponding to said lace thread;

stitching together said stitching threads and said corresponding backing threads through said substrate to form a plurality of thread pairs including lock stitches forming a two-dimensional embroidered structure;

stitching together said lace thread and said corresponding soluble thread through said substrate to form at least one temporary thread pair forming a part of said embroidered structure; and dissolving said soluble thread such that said lace thread becomes unpaired yet embedded and free to move within said embroidered structure.

2. The method of claim 1, further comprising the step of:

enclosing said plurality of thread pairs and said at least one temporary thread pair within at least one plurality of enclosing thread pairs.

3. The method of claim 2, wherein said enclosing thread pairs are formed by stitching a plurality of enclosing stitching threads and a plurality of corresponding enclosing backing threads through said plurality of thread pairs and at least one temporary thread pair.

4. The method of claim 1, further comprising the step of removing said substrate.

5. The method of claim 1, further comprising tensioning said at least one unpaired lace thread to maneuver said two-dimensional embroidered structure to form a three-dimensional embroidered structure.

6. The method of claim 5, further comprising tying the ends of the tensioned at least one unpaired lace thread to secure the form of said three-dimensional embroidered structure.

7. The method of claim 5, wherein said two-dimensional embroidered structure comprises a generally circular shape, and tensioning said at least one unpaired lace thread results in the formation of a generally dome-shaped three-dimensional embroidered structure.

8. The method of claim 5, wherein said two-dimensional embroidered structure comprises a quadrilateral, and tensioning said at least one unpaired lace thread results in the formation of a three-dimensional cylindrical embroidered structure.

9. The method of claim 5, wherein said two-dimensional embroidered structure comprises a plurality of contiguous quadrilaterals, and tensioning said at least one unpaired lace thread results in the formation of a three-dimensional open box-shaped embroidered structure.

10. The method of claim 5, wherein said two-dimensional embroidered structure comprises a plurality of contiguous quadrilaterals, and tensioning said at least one unpaired lace thread results in the formation of a three-dimensional hexahedron-shaped embroidered structure.

11. A method of aligning a series of objects, comprising:

providing a series of embroidered structures, each having plurality of apertures and at least one embedded lace thread extending continuously therethrough, said series of embroidered structures manufactured by a process comprising:

providing a soluble substrate having a stitching surface and a backing surface, a plurality of stitching threads, and a plurality of backing threads secured to said backing surface and corresponding to said plurality of stitching threads, at least one of said stitching threads and backing threads comprising at least one lace thread and at least one of said stitching threads and said backing threads comprising at least one soluble thread corresponding to said lace thread;

stitching together groups of said stitching threads and said corresponding backing threads through said soluble substrate to form groups of a plurality of thread pairs including lock stitches forming a series of two-dimensional embroidered structures;

stitching together said at least one lace thread and said corresponding at least one soluble thread through said soluble substrate to form at least one temporary thread pair forming a part of said each of said embroidered structures forming said series; and dissolving said soluble substrate and said soluble thread such that said at least one lace thread becomes unpaired yet embedded and free to move within and extending continuously through each of said embroidered structures forming said series;

fastening said series of embroidered structures to a series of misaligned objects by inserting a fastener through said apertures and into said objects; and tensioning said at least one lace thread to cause the lace thread to straighten and bring the objects fastened to the embroidered structures into alignment.

12. The method of claim 11, wherein tensioning said at least one lace thread comprises causing the ends of said lace thread to migrate in opposite directions.

13. The method of claim 11, wherein said two-dimensional embroidered structures are generally polygonal in shape.

14. The method of claim 11, wherein said at least one temporary thread pair is stitched such that said temporary thread pair zigzags between at least two of said series of embroidered structures.

15. A method of using embroidery to create a woven structure, comprising:

providing a soluble substrate having a stitching surface and a backing surface, a plurality of stitching threads, and a plurality of backing threads secured to said backing surface and corresponding to said plurality of stitching threads, each of said stitching threads and corresponding backing threads comprising one of a lace thread and a soluble thread corresponding to said lace thread;

stitching together said stitching threads and said corresponding backing threads through said soluble substrate to form a plurality of temporary thread pairs including lock stitches forming a two-dimensional embroidered structure; and dissolving said soluble substrate and said soluble threads such that said lace threads become unpaired and interwoven, transforming said two-dimensional embroidered structure into a two-dimensional woven structure.

16. The method of claim 15, wherein said woven structure includes at least one of a honeycomb shape and diagonal weave shape.

17. A three-dimensional embroidered structure, comprising:

a plurality of contiguous embroidered polygonal panels, including a base panel having a plurality of sides, each side comprising one side of a secondary panel, each secondary panel including at least one lace thread having two ends embedded therein, said at least one lace thread continuously embedded and free to move through each secondary panel, said plurality of embroidered polygonal panels manufactured by a process comprising:

providing a substrate having a stitching surface and a backing surface, a plurality of stitching threads, and a plurality of backing threads secured to said backing surface and corresponding to said plurality of stitching threads, at least one of said stitching threads and backing threads comprising at least one lace thread and at least one of said stitching threads and said backing threads comprising at least one soluble thread corresponding to said lace thread;

stitching together groups of said stitching threads and said corresponding backing threads through said substrate to form groups of a plurality of thread pairs including lock stitches forming a plurality of contiguous two-dimensional embroidered panels;

stitching together said at least one lace thread and said corresponding at least one soluble thread through said substrate to form at least one temporary thread pair forming a part of each of said secondary panels; and dissolving said soluble thread such that said at least one lace thread becomes unpaired yet embedded and free to move within and extending continuously through each of said secondary panels;

tensioning said at least one lace thread to cause said secondary panels to maneuver into a three-dimensional orientation such that each of said secondary panels comes into contact with at least one other secondary panel; and tying the ends of said at least one lace thread together such that said three-dimensional orientation is secured.

18. The three-dimensional embroidered structure of claim 17, wherein said at least one lace thread comprises a plurality of lace threads.

19. The three-dimensional embroidered structure of claim 18, wherein said plurality of lace threads extend continuously through each of said secondary panels generally parallel to one another.

20. A method of guiding at least one thread element around a series of obstacles, comprising:

providing a series of embroidered structures, each having plurality of apertures and at least one embedded lace thread extending continuously therethrough, said series of embroidered structures manufactured by a process comprising:

providing a substrate having a stitching surface and a backing surface, a plurality of stitching threads, and a plurality of backing threads secured to said backing surface and corresponding to said plurality of stitching threads, at least one of said stitching threads and backing threads comprising at least one lace thread and at least one of said stitching threads and said backing threads comprising at least one soluble thread corresponding to said lace thread;

stitching together groups of said stitching threads and said corresponding backing threads through said substrate to form groups of a plurality of thread pairs including lock stitches forming a series of two-dimensional embroidered structures;

stitching together said at least one lace thread and said corresponding at least one soluble thread through said substrate to form at least one temporary thread pair forming a part of said each of said embroidered structures forming said series; and dissolving said soluble thread such that said at least one lace thread becomes unpaired yet embedded and free to move within and extending continuously through each of said embroidered structures forming said series; and fastening said series of embroidered structures to a series of obstacles by inserting a fastener through said apertures and into said obstacle, thereby allowing said lace thread to be anchored and guided around said obstacles in a predictable path.

21. The method of claim 20, wherein said at least one thread element comprises a plurality of lace threads.

22. The method of claim 21, wherein said plurality of lace threads extend continuously through each of said series of embroidered structures generally parallel to one another.

* * * * *